US008075356B2

(12) United States Patent
Ito

(10) Patent No.: US 8,075,356 B2
(45) Date of Patent: Dec. 13, 2011

(54) MARINE VESSEL PROPULSION DEVICE AND MARINE VESSEL INCLUDING THE SAME

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 286 days.

(21) Appl. No.: 12/549,496

(22) Filed: Aug. 28, 2009

(65) Prior Publication Data

US 2010/0068953 A1 Mar. 18, 2010

(30) Foreign Application Priority Data

Sep. 12, 2008 (JP) ..... 2008-234249

(51) Int. Cl.
*B60W 10/04* (2006.01)
*B63H 21/21* (2006.01)

(52) U.S. Cl. ..... 440/86

(58) Field of Classification Search ..... 440/1, 3, 440/84–87; 477/115, 116, 125; 701/21
See application file for complete search history.

(56) References Cited

U.S. PATENT DOCUMENTS 5,827,150 A * 10/1998 Mukumoto ..... 477/101
6,102,755 A * 8/2000 Hoshiba ..... 440/1
6,587,765 B1 * 7/2003 Graham et al. ..... 701/21
6,679,740 B1 * 1/2004 Imanaka et al. ..... 440/75
2004/0142611 A1 7/2004 Itoi

FOREIGN PATENT DOCUMENTS

JP 2004-218477 A 8/2004
JP 2005-113904 A 4/2005

* cited by examiner

*Primary Examiner* — Daniel Venne
(74) *Attorney, Agent, or Firm* — Keating & Bennett, LLP

(57) ABSTRACT

A marine vessel propulsion device includes an engine arranged to generate a driving force by combustion of a fuel by an ignition unit, a thrust generating unit arranged to be driven by the driving force of the engine to generate thrust underwater, a shift mechanism unit arranged to switch between a transmitting state of transmitting the driving force of the engine to the thrust generating unit and a cut-off state of cutting off the driving force of the engine from the thrust generating unit, a shift drive unit arranged to drive the shift mechanism unit, and a control unit arranged to electrically control the shift drive unit based on a position of a shift operational unit that is arranged to be operated by a user to perform a shifting operation to a first shift position corresponding to the transmitting state, and a second shift position corresponding to the cut-off state. When changing from the first shift position to the second shift position, the control unit temporarily lowers an engine speed by starting misfire control of the ignition unit. After the start of the misfire control, the control unit controls the shift drive unit such that the shift mechanism unit starts the switching from the transmitting state to the cut-off state after a delay time period corresponding to a time from the start of misfire control to a point in time when the ignition unit actually starts to misfire.

18 Claims, 11 Drawing Sheets

MARINE VESSEL PROPULSION DEVICE AND MARINE VESSEL INCLUDING THE SAME

BACKGROUND OF THE INVENTION

1. Field of the Invention

The present invention relates to a marine vessel propulsion device that includes a shift mechanism unit. The shift mechanism unit is configured to switch between a transmitting state, in which a driving force of an engine is transmitted to a thrust generating unit, and a cut-off state, in which the driving force of the engine is cut off from the thrust generating unit. The present invention also relates to a marine vessel that includes such a marine vessel propulsion device.

2. Description of the Related Art

An outboard motor is one example of a marine vessel propulsion device. An outboard motor according to one prior art is disclosed in Japanese Unexamined Patent Application publication No. 2005-113904. This outboard motor includes a shift mechanism unit. The shift mechanism unit is capable of switching between a transmitting state, in which a driving force of an engine is transmitted to a propeller (thrust generating unit), and a cut-off state, in which the driving force of the engine is cut off from the propeller.

In the outboard motor of the prior art, a drive shaft is coupled to a crankshaft of the engine. The propeller is fixed to a propeller shaft. A mechanical forward-reverse switching mechanism (shift mechanism unit) is disposed between the drive shaft and the propeller shaft. A shift operation lever (shift operational unit), which is operable by a user, is disposed on a hull. The forward-reverse switching mechanism is mechanically connected to the shift operation lever. The forward-reverse switching mechanism is configured to switch between the transmitting state (forward drive or reverse drive) and the cut-off state (neutral) in connection with the operation of the shift operation lever.

An operation, in which the user moves the shift operation lever from the forward drive or reverse drive position to the neutral position, is referred to as a "shift-out operation." With the prior art, in the shift-out operation, misfire control of a spark plug (ignition unit) of the engine is executed as early as possible after detection of the shift-out operation. An engine speed is thereby decreased, and this is intended to lighten a load applied to the shift operation lever.

An electronic shift drive mechanism with a drive-by-wire (DBW) system has been proposed. With a DBW system, the shift operation lever and the forward-reverse switching mechanism are not connected mechanically. An electronic control unit receives position information on the shift operation lever and controls a shift drive unit, such as a shift drive motor, etc., based on the received data. The state of the shift mechanism unit is switched by the shift mechanism unit being driven by the shift drive unit.

SUMMARY OF THE INVENTION

The inventor of preferred embodiments of the present invention described and claimed in the present application conducted an extensive study and research regarding a marine vessel propulsion device, such as the one described above, and in doing so, discovered and first recognized new unique challenges and problems as described in greater detail below.

More specifically, as a result of studying marine vessel propulsion devices including the one described above, the inventor of preferred embodiments of the present invention described and claimed in the present application hypothetically considered application of a configuration, premised on a mechanical shift mechanism unit, to an electronic shift drive mechanism with the DBW system. In this case, immediately after detection of a shift-out operation, the misfire control of a spark plug of the engine is started and at the same time, driving of the shift drive unit is started.

The present inventor noted the following problems with such a configuration.

That is, a spark plug has a configuration such that ignition is performed by causing a discharge, for example, by energizing a coil for a fixed time and thereafter canceling the energization. Thus, if energization is already taking place when a shift-out operation is detected, the spark plug can no longer misfire. Thus, in actuality, misfiring is started from a subsequent spark plug. A lag may thus arise between the start of misfire control and the point in time when a spark plug actually starts to misfire and the engine speed decreases. In such a case, when the driving of the shift drive unit is started immediately after the shift-out operation, the shift drive unit is driven before the engine speed decreases. There is thus an issue that large loads are consequently applied to portions of the shift drive unit and the shift mechanism unit.

In order to overcome the previously unrecognized and unsolved problems described above, a preferred embodiment of the present invention provides a marine vessel propulsion device including an engine arranged to generate a driving force by combustion of a fuel by an ignition unit, a thrust generating unit arranged to be driven by the driving force of the engine to generate thrust underwater, a shift mechanism unit arranged to be capable of switching between a transmitting state of transmitting the driving force of the engine to the thrust generating unit and a cut-off state of cutting off the driving force of the engine from the thrust generating unit, a shift drive unit arranged to drive the shift mechanism unit, and a control unit arranged to electrically control the shift drive unit based on a position of a shift operational unit that is arranged for a user to perform a shifting operation to a first shift position and a second shift position. The first shift position corresponds to the transmitting state, and the second shift position corresponds to the cut-off state. The control unit is arranged such that when the shift operational unit is operated to change from the first shift position to the second shift position, the control unit temporarily lowers an engine speed by starting misfire control of the ignition unit. After the start of the misfire control, the control unit controls the shift drive unit so that the shift mechanism unit starts the switching from the transmitting state to the cut-off state after elapse of a first delay time period corresponding to an amount of time beginning from the start of misfire control to a point in time when the ignition unit actually starts to misfire.

With the marine vessel propulsion device having such an arrangement, when the shift operational unit is operated to change from the first shift position to the second shift position (when a shift-out operation is performed), misfire control is started to temporarily lower the engine speed. Further, the switching from the transmitting state to the cut-off state is started after the first delay time period has elapsed after the misfire control is started. Thus, even in a case where a lag occurs between the point in time when the shift-out operation is performed and the point in time when the engine speed actually starts to decrease, the shift-out can be executed smoothly. That is, the shift drive unit can be driven to reliably start the switching from the transmitting state to the cut-off state after the engine speed actually starts to decrease. The shift-out can thus be executed reliably in a state in which loads applied to the shift drive unit and the shift mechanism unit are small. Also, a consumption power of the shift drive unit, such as a shift drive motor, can be reduced because the load applied to the shift drive unit can be lightened.

The first delay time period preferably corresponds to the time from the start of the misfire control to the point in time when the ignition unit actually starts to misfire. This first delay time period may be a fixed time that is set in advance.

In a preferred embodiment of the present invention, the control unit predicts a lag time amount, from the start of the misfire control to the point in time when the ignition unit actually starts to misfire, and sets the predicted amount of lag time as the first delay time period. Thus, even in a case where the amount of lag time changes depending on a state of the engine, the switching from the transmitting state to the cut-off state can be started at a more appropriate timing based on the predicted amount of lag time.

Preferably, the control unit may be arranged to control the shift drive unit such that the shift mechanism unit starts the switching from the transmitting state to the cut-off state in an initial period in which the engine speed starts to decrease. With this configuration, the shift-out (switching from the transmitting state to the cut-off state) can be ended as early as possible after the shift-out operation by the user. Recognition by the user of the lag of execution of the shift-out due to the lag of the start of driving of the shift drive unit can thereby be effectively suppressed and minimized.

Preferably, the first delay time period may be a predicted maximum amount of lag time from the start of the misfire control to the point in time when the ignition unit actually starts to misfire. With this configuration, the shift drive unit can be driven to start the switching from the transmitting state to the cut-off state more reliably after the ignition unit starts to misfire and the engine speed actually starts to decrease.

Preferably, the control unit may be arranged to compute an ignition interval based on a number of cylinders of the engine and the engine speed when the shift operation unit is operated to change from the first shift position to the second shift position and compute the predicted maximum amount of lag time based on the ignition interval. The amount of lag time varies depending on the ignition interval, and a more appropriate predicted maximum amount of lag time can thus be computed by using the ignition interval.

Preferably, the control unit may be arranged to determine a timing of ignition of the ignition unit by a timer that is set for each ignition of the ignition unit. In this case, the control unit is preferably arranged to compute the predicted maximum amount of lag time based on the time of the timer in addition to the number of cylinders of the engine and the engine speed. With this configuration, an appropriate predicted maximum amount of lag time can be computed even in a configuration where a timer is set for each ignition to determine the timing of ignition of the ignition unit.

The engine may have a plurality of cylinders. Then, the misfire control may be performed by making the ignition unit of a pre-designated cylinder, among the plurality of cylinders, misfire. Preferably in this case, the control unit is arranged to compute the predicted maximum amount of lag time from the start of the misfire control to the point in time when the ignition unit of the pre-designated cylinder actually starts to misfire. With this configuration, an appropriate predicted maximum amount of lag time can be computed even in a configuration in which misfire control in the ignition unit of the pre-designated cylinder, among the plurality of cylinders, is performed.

In a preferred embodiment of the present invention, an engine speed commanding unit, which is arranged to issue a command to maintain the engine speed at a predetermined rotation speed based on an operation of the user, preferably is provided separately from the shift operational unit. In this case, the control unit may be arranged to control the engine speed based on a state of the engine speed commanding unit. Preferably, the control unit is arranged such that, in a case where the engine speed is controlled based on the state of the engine speed commanding unit, the control unit starts the misfire control after elapse of a second delay time period from the operation of the shift operation unit from the first shift position to the second shift position and controls the shift drive unit such that the shift mechanism unit starts the switching from the transmitting state to the cut-off state after elapse of the first delay time period after the start of the misfire control. The inventor has discovered, in developing the preferred embodiments of the present invention, that a problem may arise when the shift-out operation is performed with a high engine speed being maintained based on the command by the state engine rotation commanding unit. That is, there may be a case where the engine speed has not decreased adequately when the shift switching operation is performed after elapse of just the first delay time period from the shift-out operation. Further delay by the first delay time period is thus carried out preferably after delaying by the second delay time period from the point in time when the shift-out operation is performed. The shift mechanism unit thus starts the switching from the transmitting state to the cut-off state in the state where the engine speed has decreased sufficiently. The shift-out can thereby be executed reliably in the state in which the loads applied to the shift drive unit and the shift mechanism unit are small.

Another preferred embodiment of the present invention provides a marine vessel including a hull, and the above-described marine vessel propulsion device installed on the hull.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
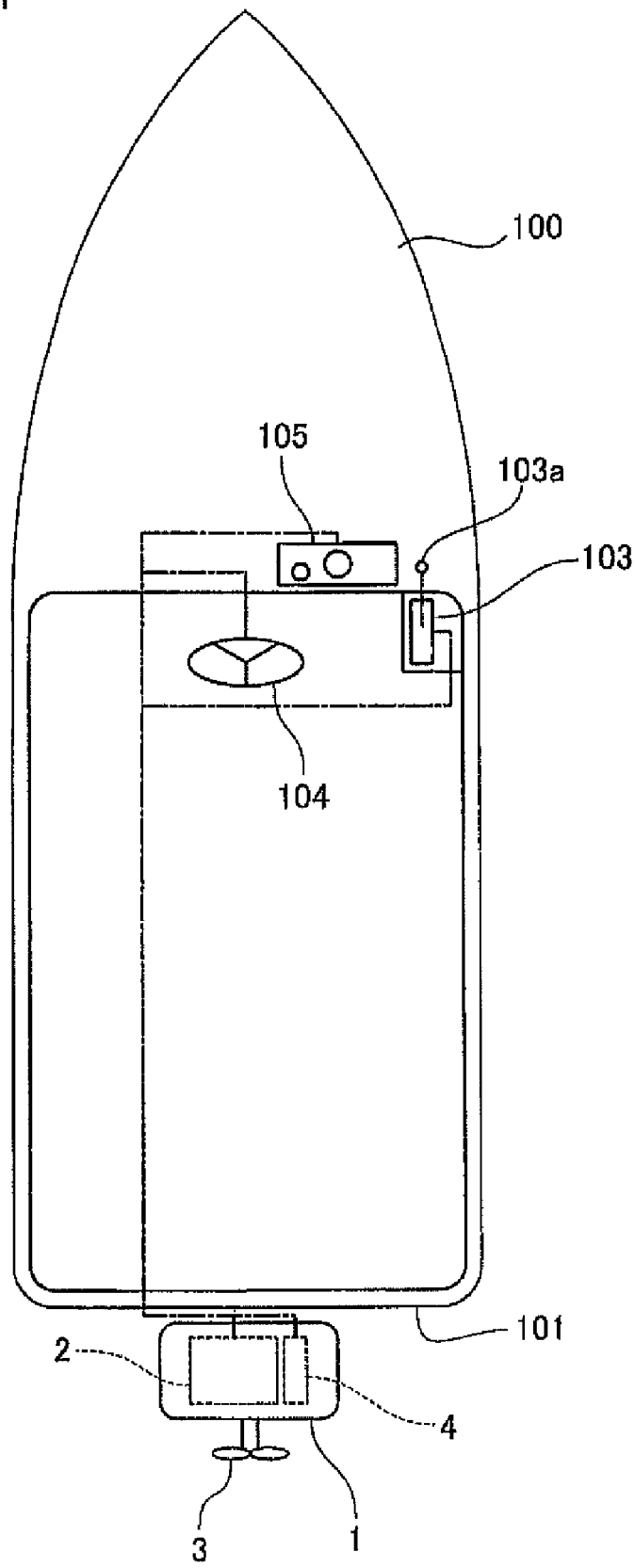
FIG. 1 is a plan view of a marine vessel that includes an outboard motor according to a first preferred embodiment of the present invention.

FIG. 1 is a schematic plan view of an overall configuration of a marine vessel that includes an outboard motor according to a first preferred embodiment of the present invention. In the present preferred embodiment, an outboard motor 1, which is one example of a marine vessel propulsion device, is attached to a stern 101 of a hull 100. The outboard motor 1 includes an engine 2, a propeller 3 arranged to be rotated by a driving force of the engine 2, and a forward-reverse switching mechanism unit 4. In addition, the propeller 3 and the forward-reverse switching mechanism unit 4 are, respectively, one example of a "thrust generating unit" and one example of a "shift mechanism unit" according to a preferred embodiment of the present invention.

A remote control apparatus 103, a steering apparatus 104, and a display unit 105 are installed at a central portion of the hull 100. The remote control apparatus 103 is arranged to be operated by a user to command a throttle opening of the engine 2 and switching of the forward-reverse switching mechanism unit 4. The steering apparatus 104 is arranged to be operated by the user to change a heading direction of the hull 100. The display unit 105 is used for display of a speed of the hull 100, etc. The remote control apparatus 103 includes, for example, a lever 103*a* that is rotatable in forward drive and reverse drive directions. Switching among neutral, forward drive, and reverse drive and acceleration operation can be performed by rotating the lever 103*a* in the forward drive and reverse drive directions. In addition, the remote control apparatus 103 is one example of a "shift operational unit" according to a preferred embodiment of the present invention.

Figure 2:
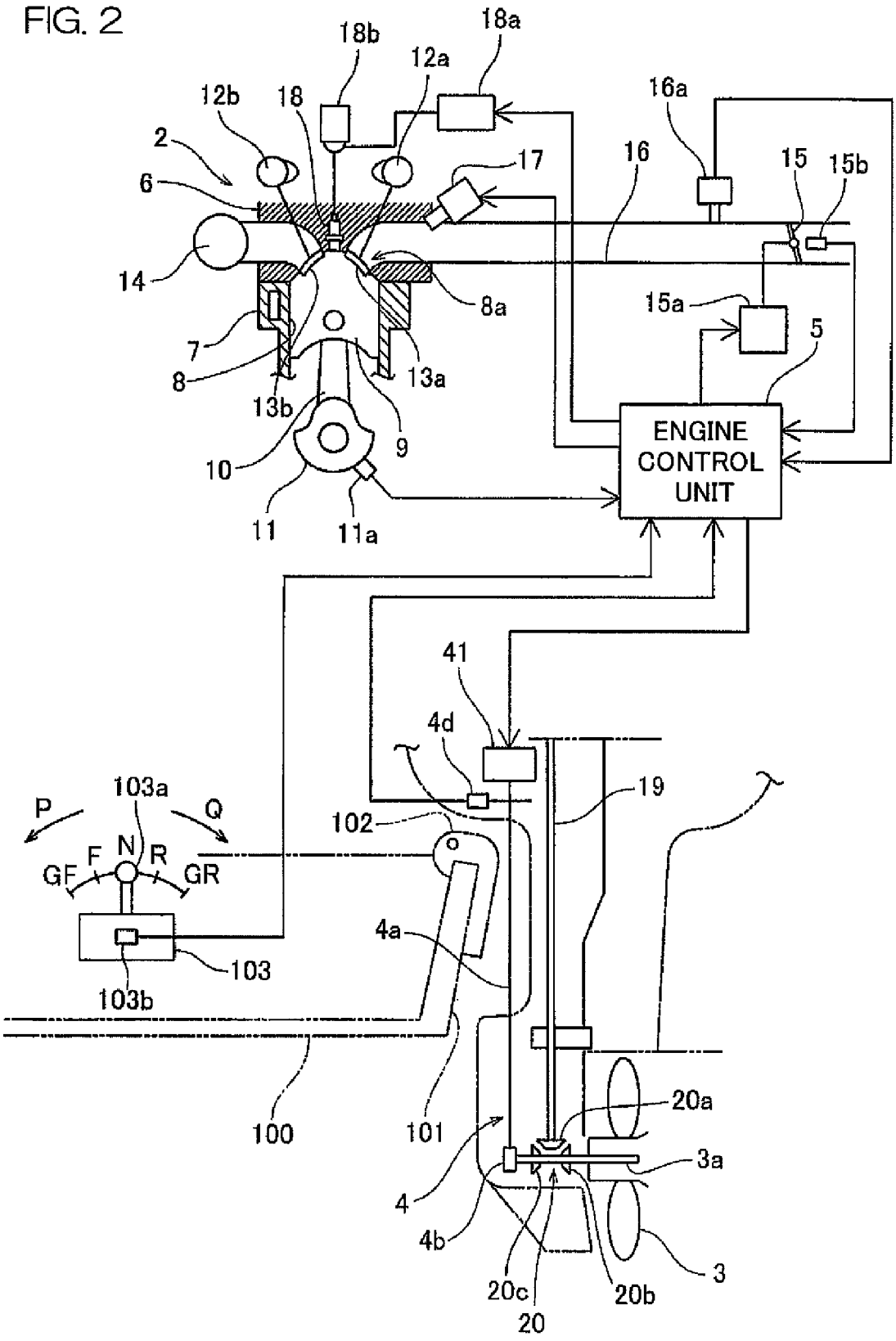
FIG. 2 is a schematic diagram of a structure of the outboard motor.

FIG. 2 is a diagram for describing a more detailed configuration of the outboard motor 1. The outboard motor 1 is attached via a clamp bracket 102 to the stern 101 of the hull 100 in a manner enabling swinging in vertical and left/right directions. The forward-reverse switching mechanism unit 4 can be switched to transmitting states (forward drive and reverse drive), in which a rotation of a crankshaft 11 of the engine 2 is transmitted to a propeller shaft 3*a*, and a cut-off state (neutral), in which a rotation of the engine 2 is cut off from the propeller shaft 3*a*. The forward-reverse switching mechanism unit 4 is configured such that a driving force for switching is transmitted from a shift actuator 41 serving as a shift drive unit. The shift actuator 41 and the rotation of the engine 2 are controlled by an engine control unit 5 (hereinafter referred to as "ECU 5"). The ECU 5 is one example of a "control unit" according to a preferred embodiment of the present invention.

In the present preferred embodiment, the engine 2 preferably is a four-cycle, four-cylinder engine. The engine 2 preferably includes four cylinders 8 and four pistons 9 that undergo reciprocating movement inside the respective cylinders 8 by combustion of a mixed gas of fuel and air inside the cylinders 8. Each cylinder 8 includes a cylinder head 6 and a cylinder block 7. The piston 9 is coupled to the crankshaft 11 via a connecting rod 10. The reciprocating motion of the piston 9 is converted to a rotational motion by the connecting rod 10 and the crankshaft 11. A crank angle sensor 11*a* is arranged close to the crankshaft 11. An output value (crank angle signal) of the crank angle sensor 11*a* is input into the ECU 5. The ECU 5 is arranged to compute an engine speed based on the output value of the crank angle sensor 11*a*.

The rotation of the crankshaft 11 is also transmitted to camshafts 12*a* and 12*b*. By respective rotations of the camshafts 12*a* and 12*b*, an intake valve 13*a* and an exhaust valve 13*b* of each cylinder 8 are driven at predetermined timings. In addition, exhaust gas exhausted from the exhaust valve 13*b* is discharged to an exterior via an exhaust passage 14.

An air passage 16 is connected to an intake port 8*a* of the cylinder 8. A throttle valve 15 is disposed inside the air passage 16. A supply amount of air supplied to the cylinder 8 through the air passage 16 is adjusted by the throttle valve 15. The throttle valve 15 is driven by an actuator 15*a*. The actuator 15*a* is electronically controlled by the ECU 5. An actual opening of the throttle valve 15 is detected by a throttle opening sensor 15*b*. An output signal of the throttle opening sensor 15*b* is input into the ECU 5.

A temperature inside the air passage 16 is detected by an intake air temperature sensor 16*a*. An output signal of the intake air temperature sensor 16*a* is input into the ECU 5. An injector 17 that injects fuel is disposed near the intake port 8*a* of the cylinder 8. Operation of the injector 17 is controlled by the ECU 5 (fuel injection control).

A spark plug 18 is disposed in the cylinder 8. By discharge of the spark plug 18 inside the cylinder 8, the mixed gas inside the cylinder 8 is ignited and combusted. Specifically, by energizing an igniter 18*a* for a predetermined time (for example, approximately a few milliseconds), a transistor of the igniter 18*a* is turned on and a primary current flows through a primary coil (not shown) of an ignition coil 18*b*. When the transistor is turned off and the primary current is cut off, a high voltage is generated in a secondary coil (not shown) of the ignition coil 18*b* by a mutual induction action of the coils, and the spark plug 18 discharges. The igniter 18*a* is electronically controlled by the ECU 5. The spark plug 18 thus discharges and ignites at a predetermined timing. The spark plug 18 is one example of an "ignition unit" according to a preferred embodiment of the present invention.

A rotation axis of the crankshaft 11 actually extends vertically. That is, the engine 2 holds the crankshaft 11 in an orientation in which its rotation axis extends vertically. A lower end of the crankshaft 11 is connected to a drive shaft 19. A rotation of the drive shaft 19 is transmitted via the forward-reverse switching mechanism unit 4 to the propeller shaft 3*a*. The propeller 3 is attached to the propeller shaft 3*a*.

The forward-reverse switching mechanism unit 4 includes a bevel gear mechanism 20. The bevel gear mechanism 20 includes a bevel gear 20*a*, installed on a lower end of the drive shaft 19, a forward drive bevel gear 20*b*, and a reverse drive bevel gear 20*c*. The forward drive bevel gear 20*b* transmits the rotation of the drive shaft 19 as a forward drive rotation to the propeller shaft 3*a*. The reverse drive bevel gear 20*c* transmits the rotation of the drive shaft 19 as a reverse drive rotation to the propeller shaft 3*a*. The forward drive bevel gear 20*b* and the reverse drive bevel gear 20*c* are configured to rotate freely with respect to the propeller shaft 3*a*.

As mentioned above, the forward-reverse switching mechanism unit 4 can be switched to the transmitting states and the cut-off state. A transmitting state is a state in which either the forward drive bevel gear 20*b* or the reverse drive bevel gear 20*c* is connected to the propeller shaft 3*a*. The cut-off state is a state in which both the forward drive bevel gear 20*b* and the reverse drive bevel gear 20*c* are cut off from the propeller shaft 3*a*.

The forward-reverse switching mechanism unit 4 further includes a shift rod 4*a*, which is rotatable and extends vertically, and a dog clutch 4*b*, which moves along the propeller shaft 3*a* in accordance with a rotation of the shift rod 4*a*. In the present preferred embodiment, the shift actuator 41, which is electronically controlled by the ECU 5, includes a shift drive motor that rotatingly drives the shift rod 4*a*.

The dog clutch 4*b* is attached to the propeller shaft 3*a* so as to rotate integrally with the propeller shaft 3*a* and be movable along the propeller shaft 3*a*. By the driving of the shift actuator 41, the dog clutch 4*b* is moved via the shift rod 4*a*. Switching among the forward drive state, the reverse drive state, and the neutral state is performed thereby. In the forward drive state, the rotation of the forward drive bevel gear 20*b* is transmitted via the dog clutch 4*b* to the propeller shaft 3*a*. In the reverse drive state, the rotation of the reverse drive bevel gear 20*c* is transmitted via the dog clutch 4*b* to the propeller shaft 3*a*. In the neutral state, the rotation of neither the forward drive bevel gear 20*b* nor the reverse drive bevel gear 20*c* is transmitted to the propeller shaft 3*a*.

The actual shift state (forward drive state, reverse drive state, or neutral state) of the forward-reverse switching mechanism unit 4 is detected by a shift position sensor 4*d*. A detection value (shift position signal) of the shift position sensor 4*d* is input into the ECU 5. The ECU 5 recognizes the actual shift state (forward drive state, reverse drive state, or neutral state) based on the shift position signal.

The remote control apparatus 103 is provided with a lever position sensor 103*b*, which preferably includes a potentiometer or an encoder, etc. A position (rotation angle) of the lever 103*a* is detected by the lever position sensor 103*b*. The lever position sensor 103*b* generates a lever position signal that indicates the position (rotation angle) of the lever 103*a*. The lever position signal is transmitted to the ECU 5.

The lever 103*a* of the remote control apparatus 103 is rotatable between a forward drive fully-open position (forward drive full-throttle position) GF and a reverse drive fully-open position (reverse drive full-throttle position) GR. A forward drive notch position F, a neutral notch position N, and a reverse drive notch position R are defined between the forward drive fully-open position GF and the reverse drive fully-open position GR. The neutral notch position N is an operation position corresponding to the neutral state of the forward-reverse switching mechanism unit 4. The forward drive notch position F is arranged between the neutral notch position N and the forward drive fully-open position GF. In addition, the reverse drive notch position R is arranged between the neutral notch position N and the reverse drive fully-open position GR. The lever 103*a* is configured to become provisionally latched at the notch positions F, N, and R. That is, when the lever 103*a* reaches the forward drive notch position F, the neutral notch position N, or the reverse drive notch position R, the lever 103*a* is held at that position and becomes unmovable by a light force. That is, the user can feel a click at the forward drive notch position F, the neutral notch position N, or the reverse drive notch position R. The user can thereby readily recognize these notch positions.

Figure 3:
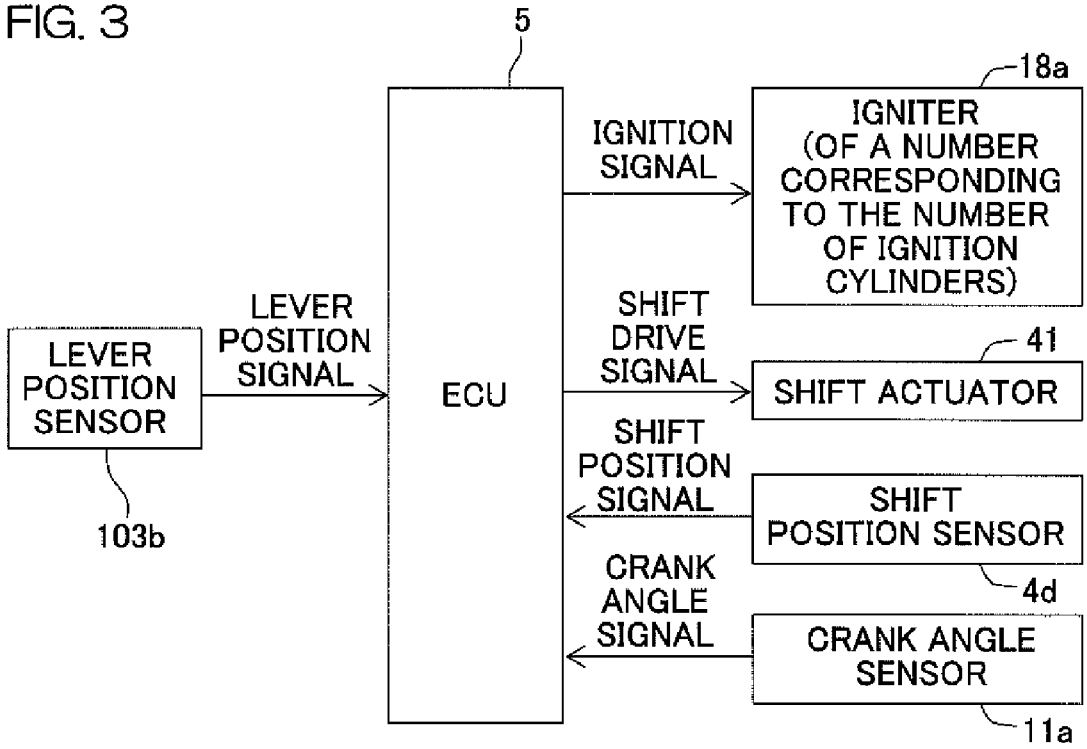
FIG. 3 is a block diagram of an electrical configuration of principal portions of the outboard motor.

FIG. 3 is a block diagram of an electrical configuration related to main controls executed by the ECU 5. The ECU 5 is configured or programmed to perform control of the engine 2 based on output values of sensors. Specifically, as shown in FIGS. 2 and 3, the ECU 5 acquires the detection values from the crank angle sensor 11*a*, the lever position sensor 103*b*, the intake air temperature sensor 16*a*, and the throttle opening sensor 15*b*. The ECU 5 is programmed to perform control of the rotation of the engine 2 by adjusting the opening of the throttle valve 15, the fuel injection amount and the fuel injection timing of the injector 17, the timing of ignition by the spark plug 18, etc., on the basis of the detection values. The ECU 5 is also programmed to switch the shift state to the forward drive state, the reverse drive state, or the neutral state by controlling the shift actuator 41 of the forward-reverse switching mechanism unit 4 based on the detection values of the lever position sensor 103*b* and the shift position sensor 4*d*.

In the first preferred embodiment, the ECU 5 is programmed to control the engine 2 to lower the engine speed temporarily when the forward-reverse switching mechanism unit 4 is switched to the neutral state from the forward drive state or the reverse drive state. By performing shift-out in a state where the engine speed is low, the engagement of the forward drive bevel gear 20*b* or the reverse drive bevel gear 20*c* with the dog clutch 4*b* can be released by a weak force and a load applied to the shift actuator 41 can thereby be lightened.

Specifically, the ECU 5 is programmed to perform a misfire control of temporarily stopping the discharge of the spark plug 18 to lower the engine speed. The misfire control is a control by which ignition is cut for a predetermined period at a portion or all of the spark plugs 18 of the plurality of cylinders (for example, four cylinders in the first preferred embodiment).

For example, the ECU 5 may be programmed to start the misfire control when it is detected that the lever 103*a* of the remote control apparatus 103 is rotated from the forward drive notch position F or the reverse drive notch position R to the neutral notch position N. Then, the ECU 5 may be programmed to end the misfire control when the shift position sensor 4*d* detects that the neutral state is entered.

A lag time period arises and is equal to the amount of time between a point in time when the misfire control is started and a point in time when misfiring is actually started. Here, in the first preferred embodiment, the ECU 5 does not start the shift-out (driving of the shift actuator 41) at the same time as the start of the misfire control. That is, the ECU 5 is programmed to delay the start of the shift-out (driving of the shift actuator 41) by the lag time amount from the start of the misfire control. This control shall be described in detail later.

Referring to FIG. 2, when the lever 103*a* of the remote control apparatus 103 is rotated in a direction of an arrow P from the neutral notch position N to the forward drive notch position F, the ECU 5 executes a forward drive shift-in control. That is, the ECU 5 controls the shift actuator 41 to switch the shift state from the neutral state to the forward drive state. Also, when the lever 103A is rotated further in the direction of the arrow P from the forward drive notch position F toward the forward drive fully-open position GF, the ECU 5 controls the throttle valve 15 so as to increase the throttle opening with an increase of the rotation angle. When the lever 103*a* is positioned at the forward drive fully-open position GF, the ECU 5 controls the throttle valve 15 to be fully open.

When the user rotates the lever 103*a* from the forward drive notch position F to the neutral notch position N, the ECU 5 executes the shift-out control. That is, the ECU 5 controls the shift actuator 41 to switch the shift state from the forward drive state to the neutral state.

In likewise manner, when the lever 103*a* is rotated in a direction of an arrow Q from the neutral notch position N to the reverse drive notch position R, the ECU 5 executes a reverse drive shift-in control. That is, the ECU 5 controls the shift actuator 41 to switch the shift state from the neutral state to the reverse drive state. Also, when the lever 103A is rotated further in the direction of the arrow Q from the reverse drive notch position R toward the reverse drive fully-open position GR, the ECU 5 controls the throttle valve 15 so as to increase the throttle opening with an increase of the rotation angle. When the lever 103*a* is positioned at the full-throttle position GR, the ECU 5 controls the throttle valve 15 to be fully open.

When the user rotates the lever 103*a* from the reverse drive notch position R to the neutral notch position N, the ECU 5 executes the shift-out control. That is, the ECU 5 controls the shift actuator 41 to switch the shift state from the reverse drive state to the neutral state.

The ECU 5 ends the shift switching control in response to the detection that the shift state (forward drive state, reverse drive state, or neutral state) has reached a switching target corresponding to the output of the shift position sensor 4*d*. For example, in switching from the reverse drive state to the neutral state, the ECU 5 sets the switching target to the neutral state. The ECU 5 then stops the driving of the shift actuator 41 when it is detected that the shift state is the neutral state based on the shift position signal from shift position sensor 4*d*.

Figure 4:
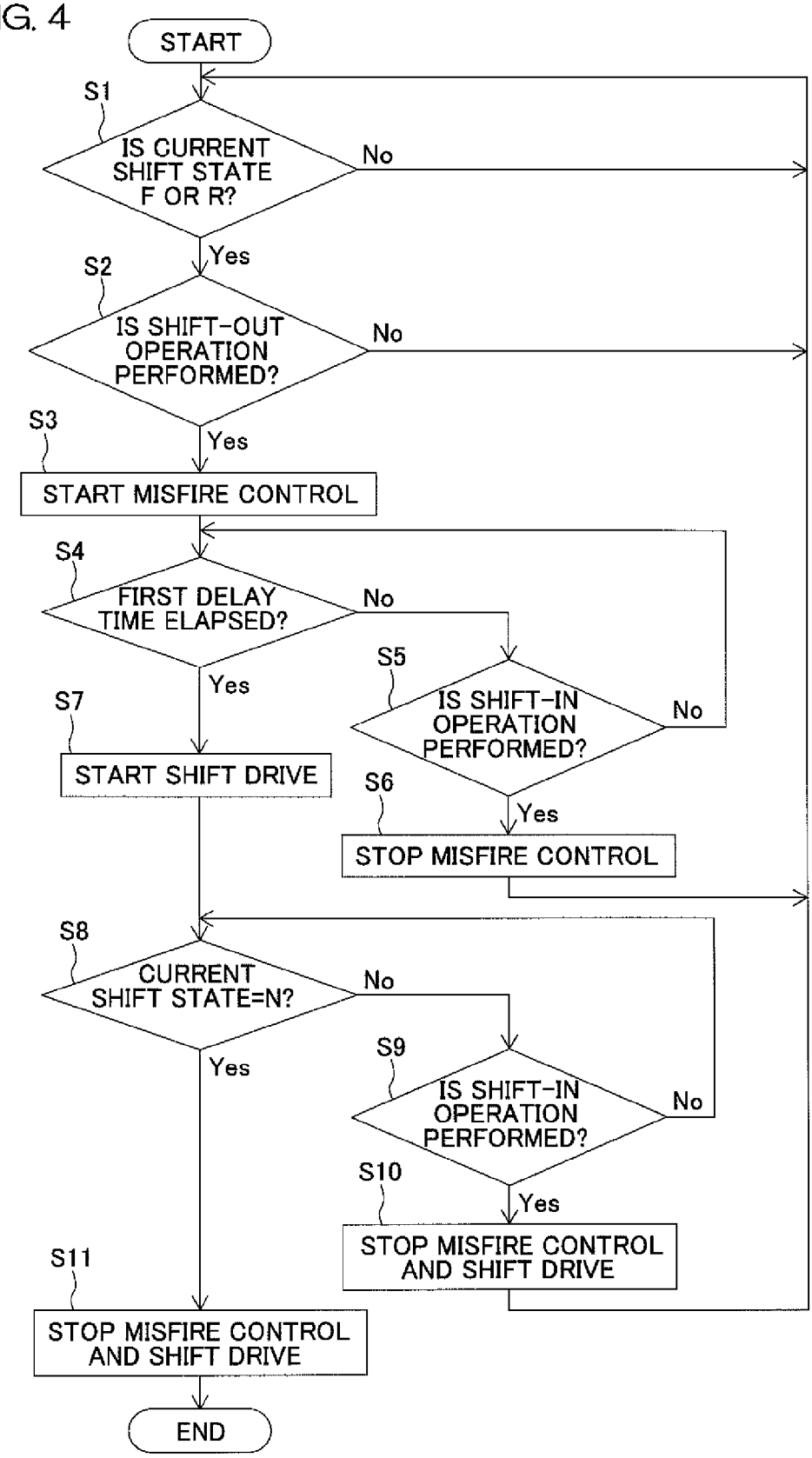
FIG. 4 is a flowchart for explaining a shift-out control of an ECU provided in the outboard motor.
Figure 5:
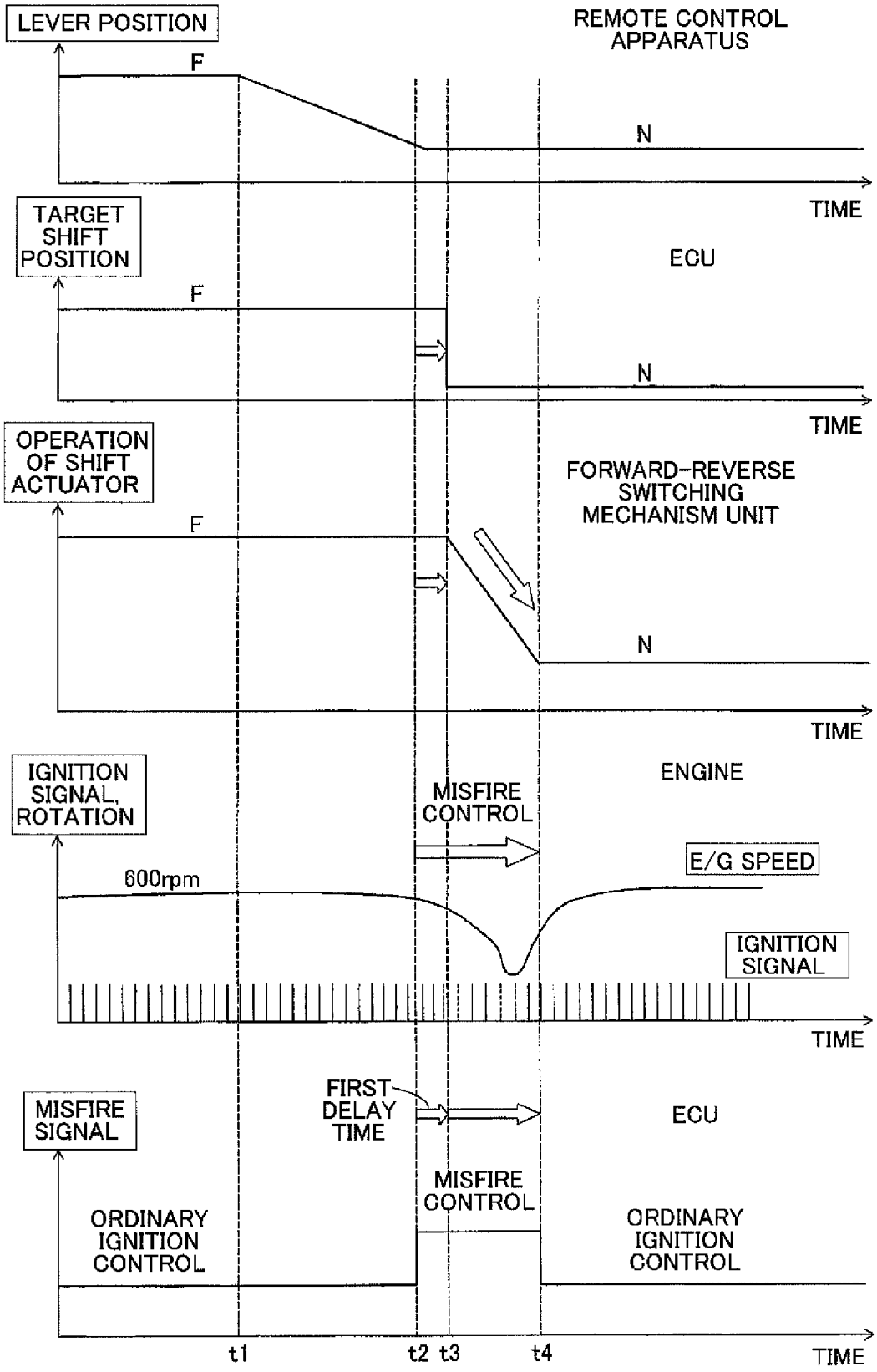
FIG. 5 is a timing chart for explaining the shift-out control of the ECU.

FIG. 4 is a flowchart for describing control details of the ECU 5 related to the switching of the shift state. FIG. 5 is a timing chart for explaining an operation example during the switching of the shift state.

Based on the shift position signal from the shift position sensor 4*d*, the ECU 5 determines whether the current shift state is the forward drive state or the reverse drive state (step S1). If the shift state is neither the forward drive state nor the reverse drive state (if the shift state is the neutral state), the determination process is repeated. If the shift state is the forward drive state or the reverse drive state, the ECU 6 determines whether or not the shift-out operation is performed (step S2). That is, the ECU 6 determines whether or not the lever 103*a* is operated to change from the forward drive notch position F or the reverse drive notch position R to the neutral notch position N.

A case where the lever 103*a*, positioned at the forward drive notch position F, is rotated in the Q direction (see FIG. 2) by a user operation started at a time t1 as shown in FIG. 5 shall now be presumed. The ECU 5 does not recognize that the lever 103*a* is operated to the neutral notch position N just by the lever 103*a* being rotated in the Q direction from the forward drive notch position F. The ECU 5 recognizes that the lever 103*a* is operated to the neutral notch position N at a time (time t2) at which the lever 103*a* is rotated to a predetermined position near the neutral notch position N. During an operation of the lever 103*a* toward the neutral notch position N, the user may further operate the lever 103*a* so as to return to forward drive or reverse drive. An unnecessary shift switching operation can be prevented in such a case.

If it is judged that the lever 103*a* is not operated to change from the forward drive notch position F to the neutral notch position N, the process of the ECU 5 returns to step S1. Each of the forward drive notch position F and the reverse drive notch position R is one example of a "first shift position" according to a preferred embodiment of the present invention, and the neutral notch position N is one example of a "second shift position" according to a preferred embodiment of the present invention.

If it is judged that the lever 103*a* is operated to change from the forward drive notch position F or the reverse drive notch position R to the neutral notch position N (step S2: YES), the ECU 5 starts the misfire control (step S3). That is, when it is judged that a shift-out operation is performed (time t2) while an ordinary ignition control is being performed, the ECU 5 switches from the ordinary ignition control to the misfire control. Specifically, the ECU 5 controls the igniter 18*a* to stop the ignition of the spark plug 18 as early as possible from the time point (time t2) when the misfire control is started. The discharge of the spark plug 18 is performed after energization for a predetermined time (e.g., approximately a few milliseconds). Once the energization is started, the discharge of the spark plug 18 cannot be interrupted. Thus, if the misfire control is started during the energization, the spark plug 18 with which the ignition is actually cut is the spark plug 18 that is scheduled to ignite next. A lag time period (t3-t2) thus arises between the time point (time t2) when the misfire control is started and the time point (time t3) when the ignition is actually cut.

Thus, in step S4, the ECU 5 determines whether or not a predetermined first delay time period has elapsed. The first delay time period is a predicted amount of time from the start of the misfire control to the point in time when the misfiring is actually started. The first delay time period may be of a preset value (fixed value) that has been set in advance. Or, an output value of a sensor (the crank angle sensor 11*a*, etc.) may be collated with a map set in advance to acquire the first delay time period, or the first delay time period may be computed from the output value of a sensor (the crank angle sensor 11*a*, etc.).

The first delay time period preferably is not more than about 100 milliseconds to about 150 milliseconds, for example. The first delay time period is set such that a total amount of time of the first delay time period and a time required for shift-out is a time such that the user does not feel a lag of the shift drive.

If the first delay time period has not elapsed (step S4: NO), the ECU 5 determines whether or not the shift-in operation is performed in step S5. That is, the ECU 5 determines whether or not the lever 103*a* is operated to change from the neutral notch position N to the forward drive notch position F (or the reverse drive notch position R). If the shift-in operation is not performed, the process of the ECU 5 returns to step S4. If the shift-in operation is performed (step S5: YES), there is no need to perform switching of the shift state. The ECU 5 thus stops the misfire control in step S6 and then returns the process to step S1.

Also, if it is determined that the first delay time period has elapsed in step S4, the ECU 5 starts the shift drive in step S7. That is, in the first preferred embodiment, the ECU 5 delays the start of the shift drive by the amount of the time of the first delay time period from the start of the misfire control. By driving the shift actuator 41, the ECU 5 moves the dog clutch 4*b* away from the forward drive bevel gear 20*b* or the reverse drive bevel gear 20*c* from the position of being engaged with the bevel gear 20*b* or 20*c*. At this time, the engine speed is decreased because the ignition of the spark plug 18 is cut, and the load applied to the shift actuator 41 is thus lightened.

More specifically, the shift drive is started at a timing when the engine speed starts to decrease due to the misfire control. At this time, a relative torque between the bevel gear 20*b* or 20*c* and the dog clutch 4*b* is small and a frictional force between them is thus small. The loads applied to the shift actuator 41, the bevel gear 20*b* or 20*c*, and the dog clutch 4*b* are thus small.

In the first preferred embodiment, the misfire control executed by the ECU 5 preferably is a control of cutting the ignition of the spark plugs 18 in two cylinders 8 among the four cylinders 8, for example. More specifically, ignition is preferably cut in two cylinders 8 that are consecutive in an ignition order. The cylinders 8 at which the ignition is cut preferably are not determined in advance in this preferred embodiment. The ECU 5 specifies one cylinder 8, with which the ignition can be cut the earliest from the start of misfire control, and another one cylinder 8 corresponding to the next in the ignition order, and performs the ignition cut in these two cylinders 8.

Next, in step S8, the ECU 5 determines, based on the detection value of the shift position sensor 4*d*, whether or not the actual shift state is the neutral state. That is, it is determined whether or not the shift-out is completed. If the actual shift state is not the neutral state, the ECU 5 determines, in step S9, whether or not the lever 103*a* is operated (shift-in operated) to the forward drive notch position F or the reverse drive notch position R. If the lever 103*a* is not operated to the forward drive notch position F or the reverse drive notch position R, the process of the ECU 5 returns to step S8. If the lever 103*a* is operated to the forward drive notch position F or the reverse drive notch position R, the ECU 5 stops the misfire control and the shift drive in step S10 and then returns to step S1.

When the actual shift state is switched to the neutral state (time t4) in step S8, the ECU 5 stops the misfire control and the shift drive in step S11. That is, the ECU 5 executes the ordinary ignition control in which the spark plugs 18 in all of the cylinders 8 are ignited.

Slightly before the time t4 at which the actual shift state becomes the neutral state, the engagement of the bevel gear 20*b* or 20*c* with the dog clutch 4*b* is disengaged. The load on the engine 2 is thereby decreased and the engine speed thus starts to increase before the time t4.

As described above, in the first preferred embodiment, the switching (shift-out) from the forward drive state or the reverse drive state to the neutral state is started after the elapse of the predetermined first delay time period after the start of the misfire control. The actual shift-out can thereby be delayed reliably until the rotation speed of the engine 2 actually starts to decrease. That is, the shift actuator 41 can be driven to start the shift-out after the rotation speed of the engine 2 actually starts to decrease. The shift-out can thereby be executed reliably in the state where the loads applied to the shift actuator 41 and the forward-reverse switching mechanism unit 4 are small. The load applied to the shift actuator 41 and the shift drive elements (dog clutch 4*b*, shift rod 4*a*, etc.) during the shift-out can thus be lightened. Also, a consumption power of the shift actuator 41 can be decreased because the load applied to the shift actuator 41 can be lightened.

Also, in the first preferred embodiment, the ECU 5 starts driving the shift actuator 41 for shift-out after the elapse of the first delay time period after the start of the misfire control as described above. The switching from the forward drive state or the reverse drive state to the neutral state is thereby started after the spark plugs 18 actually start to misfire. The loads applied to the shift actuator 41 and the forward-reverse switching mechanism unit 4 can thereby be lightened reliably.

Also, as described above, with the first preferred embodiment, the ECU 5 starts the switching from the forward drive state or the reverse drive state to the neutral state in an initial period in which the engine speed starts to decrease. The shift-out can thereby be ended as early as possible even when the start of driving of the shift actuator 41 is delayed by just the first delay time period after the shift-out operation by the user. The amount of time from the point at which the user performs the shift-out operation to the point at which the shift-out is actually executed by the forward-reverse switching mechanism unit 4 can thereby be shortened. Recognition by the user of lag of execution of the shift-out due to lag of the start of driving of the shift actuator 41 can thus be effectively suppressed and minimized.

When the shift-out operation is performed, the ECU 5 does not simply wait for the engine speed to decrease. When the shift-out operation is performed, the ECU 5 actively lowers the engine speed by the misfire control and meanwhile waits for the elapse of the first delay time period corresponding to the time until the decrease of the engine speed due to the misfire control actually starts. The driving of the shift actuator 41 can thereby be started to perform the shift-out at a timing at which the engine speed starts to decrease. Thus, at the timing at which the shift-out is performed, the relative torque between the bevel gear 20*b* or 20*c* and the dog clutch 4*b* is low, and accordingly, the frictional force between the two is small. The loads on the shift actuator 41 and the forward-reverse switching mechanism unit 4 can thereby be minimized.

During a development of preferred embodiments of the present invention, the inventor of the present application has considered a comparative example having a configuration such that the shift-out is performed after waiting for the engine speed to decrease in accompaniment with full closure of the throttle and without performing misfire control. However, with such a configuration, a lag time period on the order of several seconds, for example, arises between the shift-out operation by the user and the start of driving of the shift actuator. On the other hand, with the present preferred embodiment, the lag time period from the shift-out operation to the start of driving of the shift actuator 41 is a period of time within a single cycle of the engine 2 and is approximately several hundred milliseconds at the most, for example. Thus, with the configuration of the present preferred embodiment, the shift drive is extremely highly responsive with respect to the shift-out operation. In particular, shift operations are performed frequently during launching from and docking on shore. Thus, with the configuration of the present preferred embodiment that exhibits high responsiveness to shift operations, excellent marine vessel maneuvering characteristics can be provided, especially during launching from and docking on shore.

Also, with the abovementioned comparative example, depending on the marine vessel speed, the engine speed does not decrease promptly. That is, due to advancing of the marine vessel by inertia, the propeller rotates, and this rotation of the propeller is transmitted to the engine. The time taken until the engine speed decreases is thus made longer, and the lag time period from the shift-out operation to the driving of the shift actuator thus becomes even longer. Moreover, the lag time period depends on a structure of the hull as well. That is, the lag time period is long with a large hull, and with a small hull, the lag time period is comparatively short. Characteristics of the entire marine vessel should thus be taken into consideration in determining the lag time period from the shift-out operation to the driving of the shift actuator. A boat builder arbitrarily determines which outboard motor is to be installed in which hull according to requests of a customer. It is thus practically impossible to set the lag time period in consideration of the characteristics of the entire marine vessel in advance or to determine a method of computing the lag time period in advance.

On the other hand, with the present preferred embodiment, the misfire control is started in response to the shift-out operation and the driving of the shift actuator 41 is delayed by the first delay time period, which corresponds to the lag time period until misfiring is actually performed. The first delay time period is thus an extremely short amount of time that is within a single cycle of the engine 2 and can be set regardless of the structure of the hull 100 on which the outboard motor 1 is installed.

Further, the configuration of the present preferred embodiment is advantageous even in performing braking of the marine vessel by reversing the rotation direction of the propeller. For example, there is a case where braking of the marine vessel is performed by reversing the propeller rotation direction by switching the shift state from the forward drive state to the reverse drive state via the neutral state. In this case, with the present preferred embodiment, when the lever 103*a* is operated (shift-out operated) from the forward drive notch position F to the neutral notch position N, the shift actuator 41 is driven within several hundred milliseconds, for example, and the shift-out is performed. Thus, when the lever 103*a* is operated to change to the reverse drive notch position R, the forward-reverse switching mechanism unit 41 is switched immediately to the reverse drive state by the driving of the shift actuator 41. The braking force due to reversal of the propeller rotation direction can thus be generated promptly.

As described above, with the present preferred embodiment, by driving of the shift actuator 41 at a timing that is in accordance with the misfire control, the amount of time from the shift-out operation to the actual shift-out can be shortened. Moreover, such highly responsive shift-out can be realized in the state where the loads on the shift actuator 41 and the forward-reverse switching mechanism unit 4 are reduced.

Second Preferred Embodiment

Figure 6:
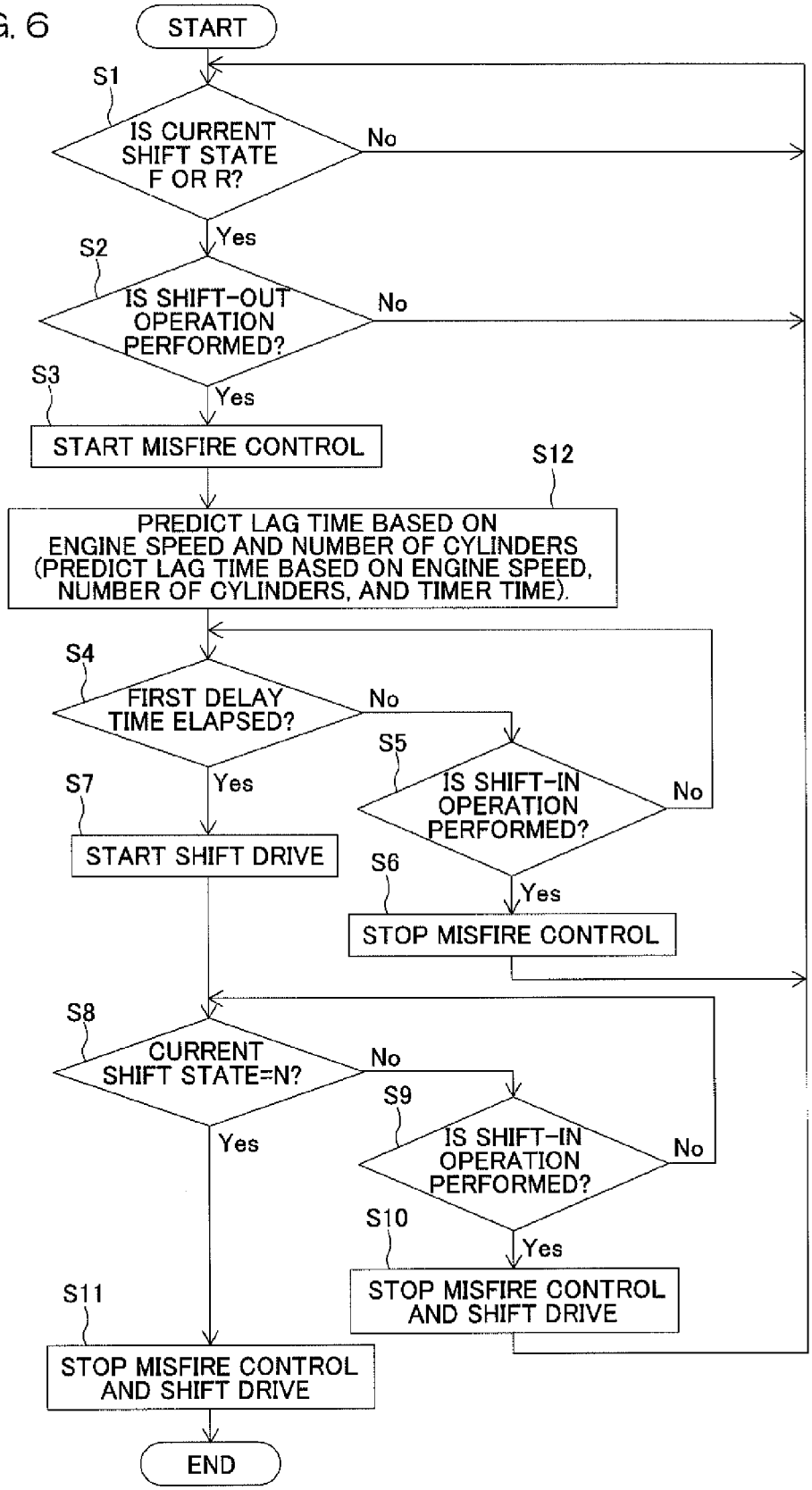
FIG. 6 is a flowchart for explaining a shift-out control in an outboard motor according to second to fourth preferred embodiments of the present invention.
Figure 7:
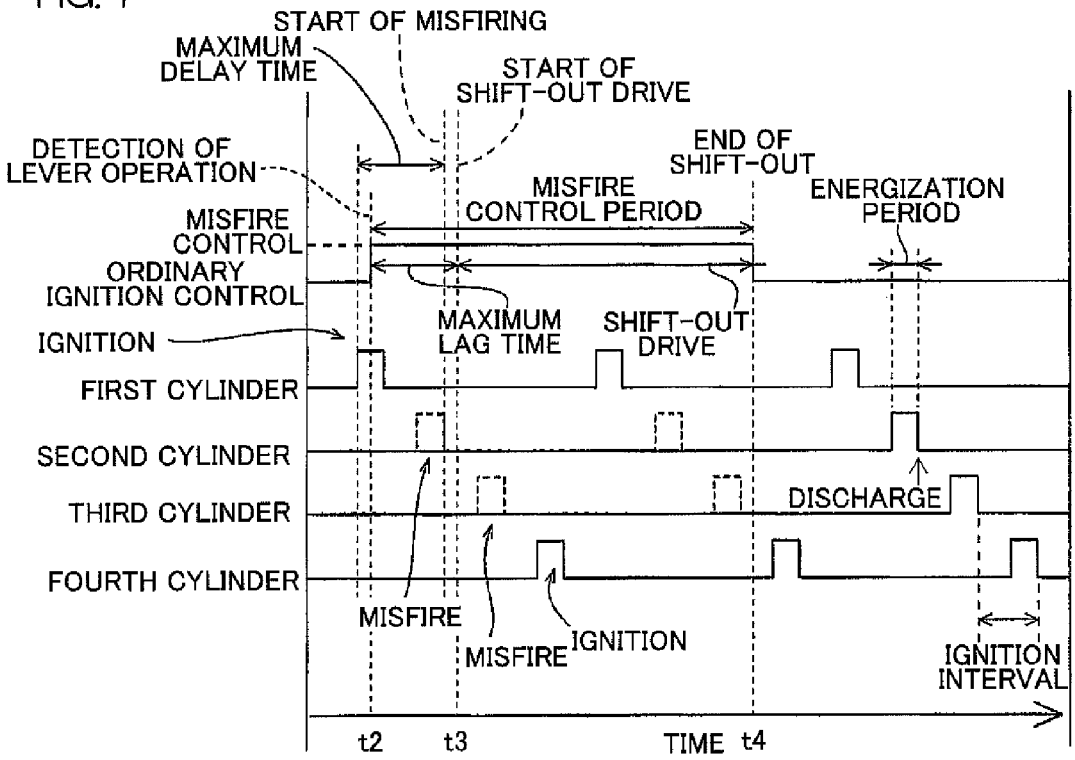
FIG. 7 is a timing chart for explaining the shift-out control of the outboard motor according to the second preferred embodiment of the present invention.

FIGS. 6 and 7 are, respectively, a flowchart and a timing chart for explaining an operation of controlling the engine and the forward-reverse switching mechanism unit by the ECU of an outboard motor according to a second preferred embodiment of the present invention. The structures of the marine vessel and the outboard motor according to the second preferred embodiment preferably are the same as those of the first preferred embodiment shown in FIGS. 1 to 3. Also, the flowchart of FIG. 6 differs from the flowchart of FIG. 4 in that step S12 is carried out between step S3 and step S4.

In the second preferred embodiment, the lag time period (predicted lag time period) from the point in time when the misfire control is started to the point in time when the misfiring is actually started is computed (predicted). In the second preferred embodiment, after starting the misfire control in step S3, the ECU 5 computes the lag time amount based on the engine speed at the point in time when the misfire control is started and the number of cylinders (for example, four cylinders in the second preferred embodiment) in step S12. That is, the ECU 5 executes a computation for predicting the lag time amount from the point in time when the misfire control is started to the point in time at which the driving of the shift actuator 41 is started. In the second preferred embodiment, the ECU 5 computes a maximum lag time amount (predicted maximum lag time amount) from the point in time when the misfire control is started to the point in time when the misfiring is actually started. The predicted maximum lag time amount is used as the first delay time period.

As shown in FIG. 7, after the igniter 18*a* is energized for a fixed amount of time, the energization is interrupted. Upon the interruption of the energization, a discharge occurs at the spark plug 18 and the fuel inside the cylinder 8 is ignited. When the igniter 18*a* of the spark plug 18 of a first cylinder is already being energized at the point in time when the misfire control is started, the first cylinder can no longer be misfired. The actual misfiring is thus started with a subsequent, second cylinder by canceling the energization of the second cylinder. More specifically, the point in time when the misfiring is actually started is a scheduled discharge time point (scheduled energization interruption point) of the spark plug 18 that is to misfire.

Thus, in the second preferred embodiment, the maximum lag time amount from the point in time when the misfire control is started to the point in time when the misfiring is actually started is a sum of an ignition interval and an energization time of the igniter 18*a* (which is, for example, a few milliseconds). The ignition interval is an interval between adjacent ignition timings. More specifically, the ignition interval is the interval between the ignition timing of the first cylinder and the ignition timing of the second cylinder.

The ignition interval is computed based on the engine speed at the point in time when the misfire control is started and the number of cylinders (four cylinders). For example, in a four-cylinder, four-cycle engine, ignition is performed twice per single rotation of the engine, and the ignition interval is thus approximately 50 milliseconds when the engine speed is 600 rpm, for example. The maximum lag time amount is thus approximately 50 milliseconds plus the energization time (few milliseconds), for example. In a case where the engine speed is 1200 rpm, the ignition interval is approximately 25 milliseconds, for example. The maximum lag time amount is thus approximately 25 milliseconds plus the energization time (few milliseconds), for example.

The ECU 5 starts the driving of the shift actuator 41 after the elapse of the maximum lag time amount (after the elapse of the first delay time period) from the point in time when the misfire control is started. The driving of the shift actuator 41 can thereby be started reliably after the misfiring actually starts (after the engine speed starts to decrease).

The misfire control in the second preferred embodiment is preferably the same as the misfire control in the first preferred embodiment. That is, the ignition is cut in the spark plugs 18 of two cylinders among the four cylinders. At which two cylinders ignition is to be cut is not previously determined, and the ignition is cut in the cylinder with which the ignition can be cut the earliest after starting the misfire control, and in the cylinder of the ignition timing subsequent that of the former cylinder.

As described above, with the second preferred embodiment, the ECU 5 computes the predicted maximum lag time amount from the point in time when the misfire control is started to the point in time when the spark plug 18 actually begins to misfire. Further, the ECU 5 starts the switching from the forward drive state or the reverse drive state to the neutral state after the elapse of the predicted maximum lag time amount (after the elapse of the first delay time period) from the start of misfire control. The shift actuator 41 can thereby be driven reliably to start the switching from the transmitting state to the cut-off state after the rotation speed of the engine 2 actually starts to decrease after the spark plug 18 starts to misfire. The shift-out can thus be executed in the state where the loads applied to the shift actuator 41 and the forward-reverse switching mechanism unit 4 are small.

Also, with the second preferred embodiment, the ECU 5 computes the ignition interval based on the number of cylinders of the engine 2 and the engine speed at the point in time when the shift-out operation is performed as described above. The ECU 5 computes the predicted maximum lag time amount (first delay time period) based on the ignition interval, and can thus obtain a more appropriate predicted maximum lag time amount (first delay time period).

Other advantages of the second preferred embodiment are the same as those of the first preferred embodiment.

Third Preferred Embodiment

Figure 8:
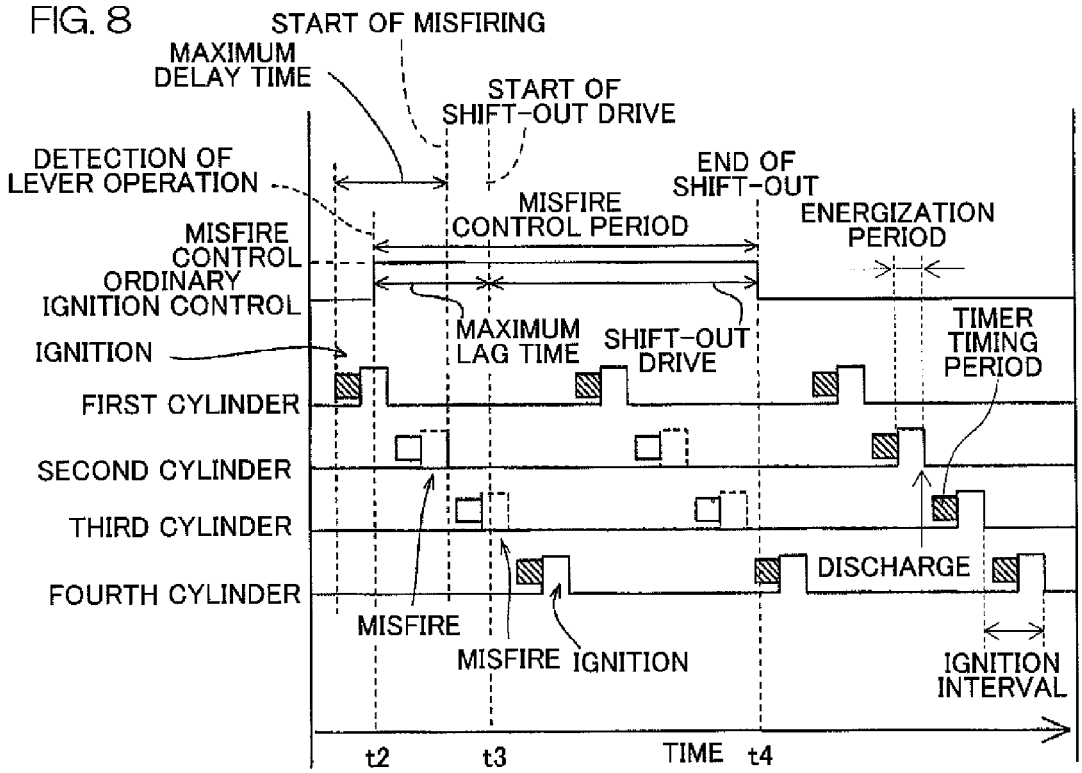
FIG. 8 is a timing chart for explaining the shift-out control of the outboard motor according to the third preferred embodiment of the present invention.

FIG. 8 is a timing chart for explaining an operation of controlling the engine and the forward-reverse switching mechanism unit by the ECU of an outboard motor according to a third preferred embodiment of the present invention. The above described FIG. 6 shall be referred to again in regard to the control operation. Also, the structures of the marine vessel and the outboard motor according to the third preferred embodiment are preferably the same as those of the first preferred embodiment shown in FIGS. 1 to 3.

Unlike in the second preferred embodiment, the ECU 5 determines the ignition timing by using a timer in the third preferred embodiment. Specifically, in the third preferred embodiment, after starting the misfire control in step S3 of FIG. 6, the ECU 5 predicts the maximum lag time amount in step S12 of FIG. 6. That is, the ECU 5 uses the engine speed at the point in time when the misfire control is started, the number of cylinders (for example, four cylinders in the third preferred embodiment), and a time period of the timer. Based on these factors, the ECU 5 computes the maximum lag time amount from the point in time when the misfire control is started to the point in time when the driving of the shift actuator 41 is started.

In the third preferred embodiment, the ECU 5 sets the timer at a point in time corresponding to a predetermined crank angle. The predetermined crank angle corresponds, for example, to a point in time (for example, BTDC 90° (before TDC 90°)) preceding a top dead center (TDC) of the piston 9 (see FIG. 2) in the cylinder 8 by a fixed angle (for example, 90 degrees). The ECU 5 computes an amount of time required for the crank angle to change from the BTDC90° to the TDC, sets the timer to this amount of time, and then makes the timer start a timing process. The ECU 5 is programmed to start energization of the igniter 18*a* to perform ignition by the spark plug 18 at the point in time when the time period set in the timer has elapsed. That is, the ECU 5 is programmed to set the timer for each cylinder and to energize the igniter 18*a* of a cylinder for a fixed time period when the time runs out at the corresponding timer. In FIG. 8, the time period in which the timer is performing a timing process is indicated by hatching.

As shown in FIG. 8, the ECU 5 is programmed such that if the timer is already set for the spark plug 18 of the first cylinder at the point in time when the misfire control is started, the misfiring of that spark plug 18 is not performed. This is because although it is possible to cancel the timer, a complex control is required to enable cancellation of the timer. Also, as in the second preferred embodiment, the spark plug 18 cannot be misfired while its igniter 18*a* is being energized already.

Thus, in the third preferred embodiment, the maximum lag time amount from the start of the misfire control to the point in time when the misfiring is actually started is a sum of the ignition interval, the energization time of the igniter 18*a*, and the set time period of the timer. The point in time when the misfiring is actually started is specifically the predicted discharge time point of the spark plug 18 to be misfired and corresponds to an energization end point of the igniter 18*a*. The ignition interval is, for example, the interval between the ignition timing of the first cylinder and the ignition timing of the second cylinder.

As in the second preferred embodiment, the ignition interval is computed based on the engine speed at the point in time when the misfire control is started and the number of cylinders (e.g., four cylinders). Also, the set time of the timer is the time required for the crankshaft 11 to rotate from the BTDC90° to the TDC and can thus be computed from the engine speed. For example, in a case where the engine speed is 600 rpm, the amount of time required for the crankshaft 11 to rotate from the BTDC90° to the TDC is approximately 25 milliseconds and the ignition interval is approximately 50 milliseconds. The maximum lag time amount is thus approximately 75 milliseconds plus the energization time (few milliseconds), for example. In the case where the engine speed is 1200 rpm, the time required for the crankshaft 11 to rotate from the BTDC90° to the TDC is approximately 12.5 milliseconds and the ignition interval is approximately 25 milliseconds, for example. The maximum lag time is thus approximately 37.5 milliseconds plus the energization time (few milliseconds), for example.

The ECU 5 starts the driving of the shift actuator 41 after the elapse of the maximum lag time amount (after the elapse of the first delay time period) from the point in time when the misfire control is started. The driving of the shift actuator 41 can thereby be started reliably after the misfiring actually starts (after the engine speed starts to decrease).

As described above, with the third preferred embodiment, the ECU 5 uses the timer that is set for each ignition of the spark plug 18 to determine the timing at which the spark plug 18 is ignited. The ECU 5 thus computes the predicted maximum lag time amount on the basis of the time period of the timer as well. An appropriate predicted maximum lag time amount (first delay time period) can thereby be computed.

Other advantages of the third preferred embodiment are the same as those of the second preferred embodiment.

Fourth Preferred Embodiment

Figure 9:
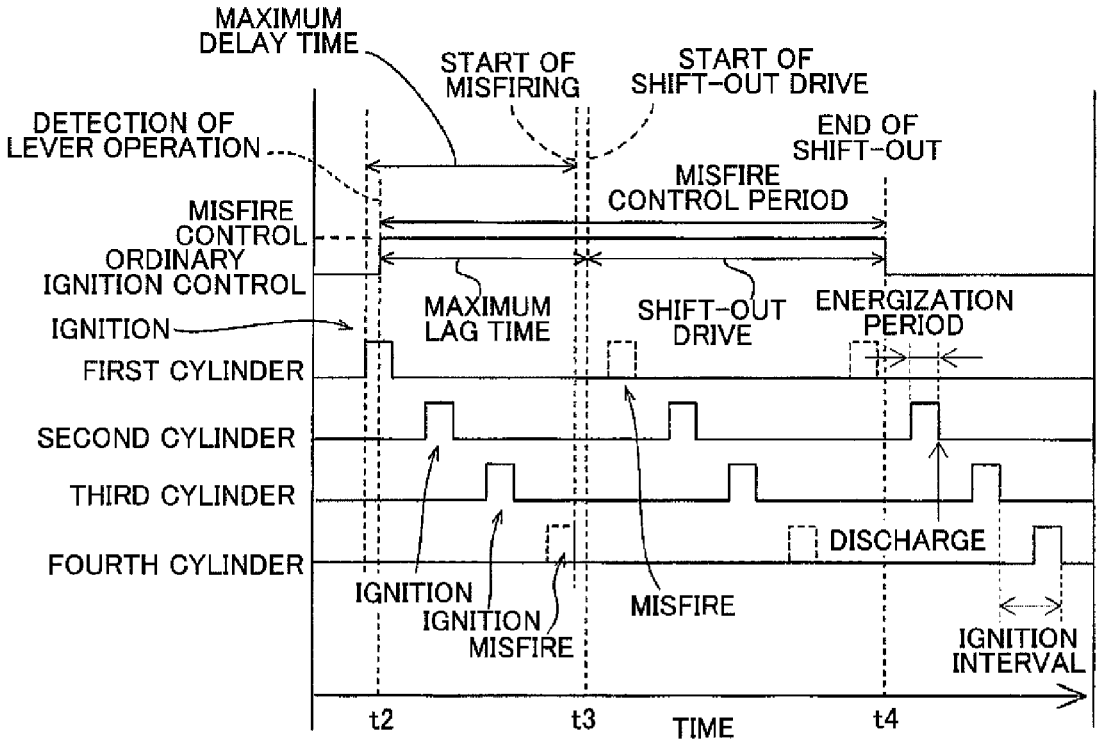
FIG. 9 is a timing chart for explaining the shift-out control of the outboard motor according to the fourth preferred embodiment of the present invention.

FIG. 9 is a timing chart for explaining an operation of controlling the engine and the forward-reverse switching mechanism unit by the ECU of an outboard motor according to a fourth preferred embodiment of the present invention. FIG. 6 shall be referred to again in regard to the control operation. Also, the structures of the marine vessel and the outboard motor according to the fourth preferred embodiment preferably are the same as those of the first preferred embodiment shown in FIGS. 1 to 3.

In the fourth preferred embodiment, the cylinders that are to misfire during the misfire control are determined in advance. Accordingly, the method for computing the lag time amount from the point in time when the misfire control is started to the point in time when misfiring is actually started differs from that of the second preferred embodiment.

In the fourth preferred embodiment, after starting the misfire control in step S3 (see FIG. 6), the ECU 5 computes the predicted lag time amount (first delay time period) in step S12. Specifically, the ECU 5 uses the engine speed at the point in time when the misfire control is started, the number of cylinders (for example, four cylinders in the fourth preferred embodiment), and the number of ignitions until the ignition timing of a spark plug 18 scheduled to misfire. Using these factors, the ECU 5 computes the predicted lag time amount (first delay time period) from the point in time when the misfire control is started to the point in time when the driving of the shift actuator 41 is started. In the fourth preferred embodiment, the computed predicted lag time amount is the maximum lag time amount from the point in time when the misfire control is started to the point in time when the misfiring is actually started.

In the present preferred embodiment, the first cylinder and the fourth cylinder are set in advance to misfire during the misfire control. As shown in FIG. 9, if at the point in time when the misfire control is started, the igniter 18*a* of the spark plug 18 of the first cylinder is already being energized, the first cylinder cannot be made to misfire. Further, the second cylinder and the third cylinder do not misfire, and the misfiring thus actually starts from the fourth cylinder by cancellation of the energization at the fourth cylinder. The number of ignitions up to the ignition timing of the spark plug 18 of the fourth cylinder that is scheduled to misfire is thus three. The lag time amount until the misfiring is actually started is the maximum when the start of energization of the igniter 18*a* of the spark plug 18 of the first cylinder coincides with the misfire control start timing.

Thus, in the fourth preferred embodiment, the maximum lag time amount from the point in time when the misfire control is started to the point in time when the misfiring is actually started is a sum of the total of the ignition intervals from the first cylinder to the fourth cylinder and the energization time amount (e.g., approximately a few milliseconds) of the igniter 18*a*. The point in time when the misfiring is actually started is the scheduled discharge time point of the spark plug 18 that is to misfire. For example, in the case of the four-cylinder, four-cycle engine, a single ignition interval is approximately 50 milliseconds when the engine speed is 600 rpm. Also, ignition takes place at the first cylinder, second cylinder, and the third cylinder from the start of misfire control to the start of misfiring, and thus the number of ignitions is three. Thus, the total of the ignition intervals from the first cylinder to the fourth cylinder is approximately 150 milliseconds (50 milliseconds×3), for example. The maximum lag time is thus approximately 150 milliseconds plus the energization time (e.g., approximately a few milliseconds), for example.

As described above, with the fourth preferred embodiment, the ECU 5 computes the predicted maximum lag time amount (first delay time period) from the point in time when misfire control is started to the point in time when the spark plug 18 of the cylinder designated in advance actually starts to misfire. An appropriate predicted maximum lag time amount can thus be computed even in the case of performing engine speed decreasing control by making the spark plugs 18 of predesignated cylinders among the plurality of cylinders misfire.

Other advantages of the fourth preferred embodiment are the same as those of the second preferred embodiment.

Figure 10:
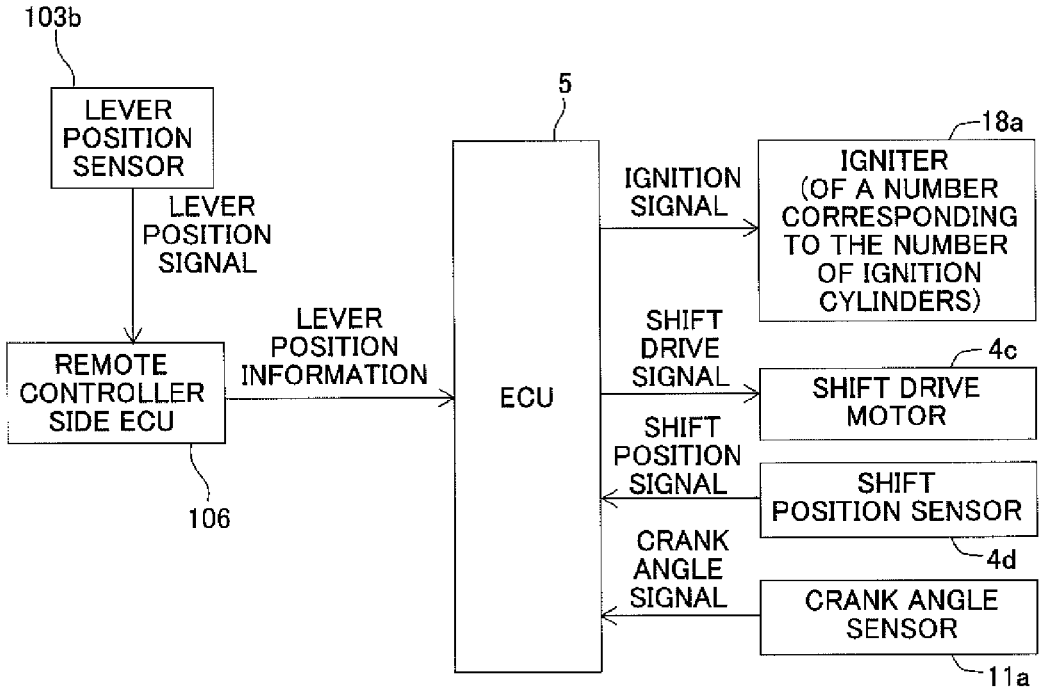
FIG. 10 is a block diagram of an electrical configuration of an outboard motor according to a modification example of the first to fourth preferred embodiments of the present invention.

FIG. 10 is a block diagram of an electric configuration of a marine vessel according to a modification example to which the first to fourth preferred embodiments can be applied. With each of the first to fourth preferred embodiments, an example where the ECU 5 preferably directly receives the detection value of the lever position sensor 103*b* has been described. On the other hand, with the modification example shown in FIG. 10, a remote controller ECU 106 is provided at the hull 100 side. The detection value of the lever position sensor 103*b* is transmitted to the ECU 5 via the remote controller side ECU 106.

Fifth Preferred Embodiment

Figure 11:
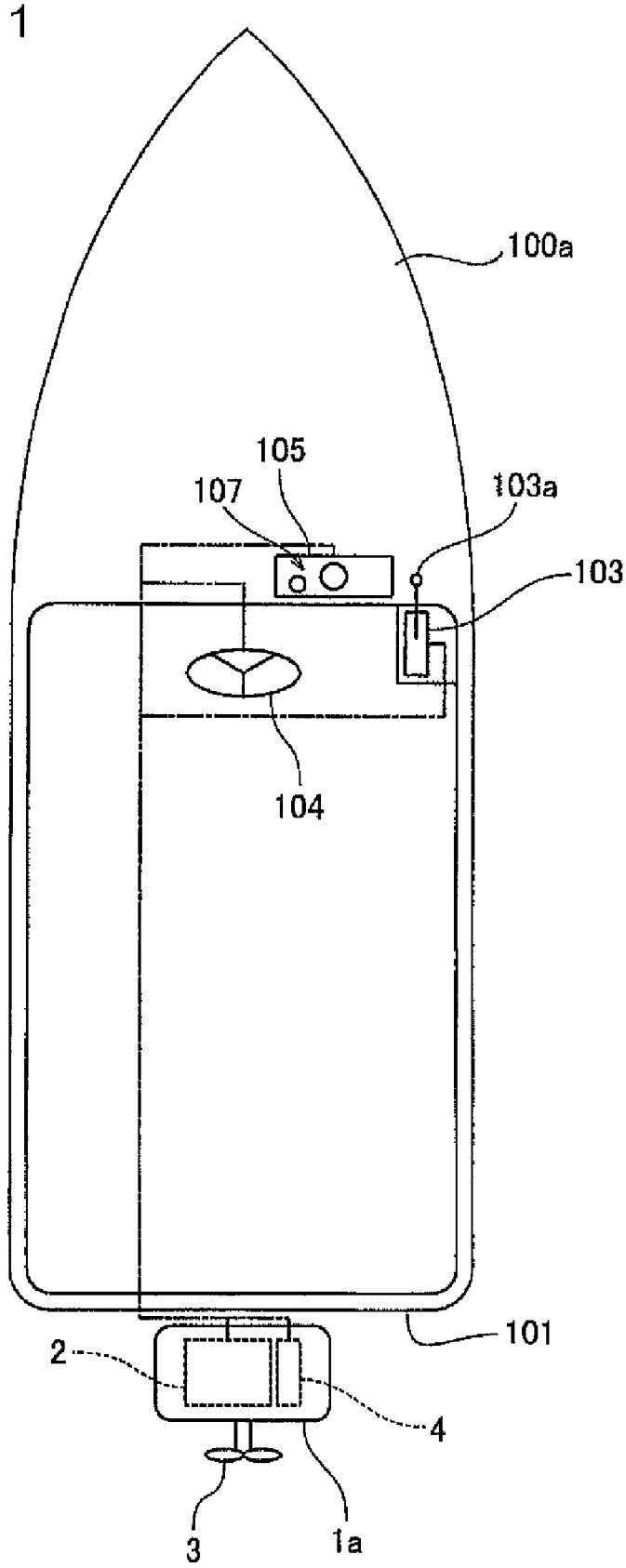
FIG. 11 is a plan view of a marine vessel that includes an outboard motor according to a fifth preferred embodiment of the present invention.

FIG. 11 is a schematic plan view of a marine vessel that includes an outboard motor according to a fifth preferred embodiment of the present invention. The outboard motor 1*a* according to the fifth preferred embodiment shall now be described with reference to FIGS. 2 and 11. In the fifth preferred embodiment, the outboard motor 1*a* includes a variable troll control function.

In the fifth preferred embodiment, a gauge unit 107 arranged for an operator to check the engine speed is disposed in a hull 100*a* as shown in FIG. 11. The gauge unit 107 is connected to the ECU 5 of the outboard motor 1*a*. The gauge unit 107 is one example of an "engine rotation commanding unit" according to a preferred embodiment of the present invention.

The gauge unit 107 preferably includes a button (not shown). When the user presses this button, the gauge unit 107 generates a variable troll control commanding signal. The ECU 5 of the outboard motor 1*a* is programmed to perform a variable troll control on the engine 2 when it receives the variable troll control commanding signal. The variable troll control is a control of maintaining the engine speed at a predetermined target rotation speed set by the user regardless of the position of the lever 103*a* of the remote control apparatus 103.

Specifically, during the variable troll control, the ECU 5 increases the opening of the throttle valve 15 (see FIG. 2) if the engine speed is lower than the target rotation speed. Also, the ECU 5 decreases the opening of the throttle valve 15 if the engine speed is higher than the target rotation speed. During the variable troll control, the ECU 5 controls the actuator 15*a* such that the opening of the throttle valve 15 varies in this manner. The target rotation speed is, for example, 1000 rpm to 3000 rpm, which is a higher rotation speed than an idling rotation speed.

Figure 12:
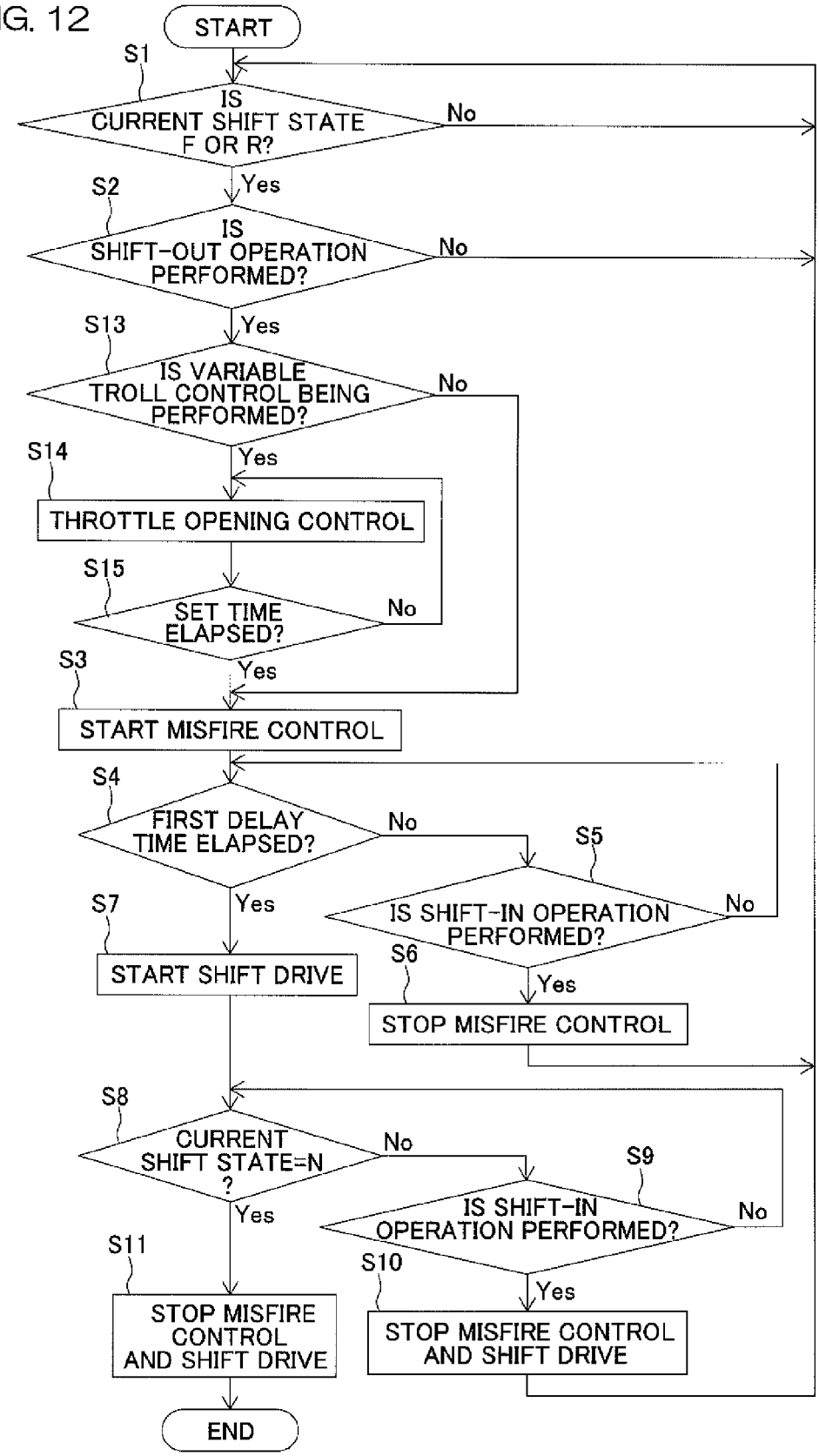
FIG. 12 is a flowchart for explaining a shift-out control of the outboard motor according to the fifth preferred embodiment of the present invention.
Figure 13:
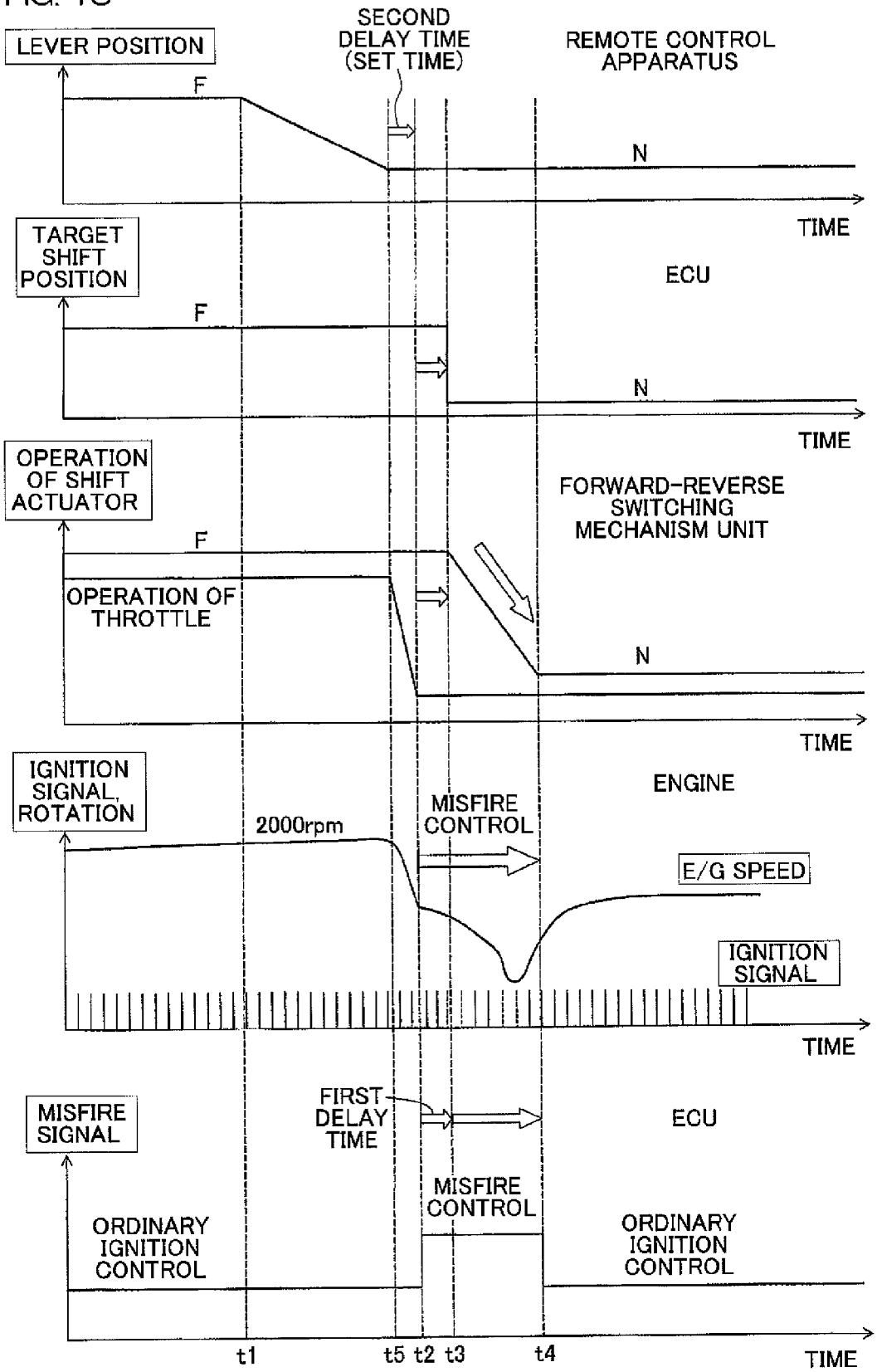
FIG. 13 is a timing chart for explaining the shift-out control of the outboard motor according to the fifth preferred embodiment of the present invention.

FIGS. 12 and 13 are, respectively, a flowchart and a timing chart for explaining an operation of controlling the engine and the forward-reverse switching mechanism unit by the ECU of the outboard motor according to the fifth preferred embodiment of the present invention. The operation of controlling the engine 2 and the forward-reverse switching mechanism unit 4 by the ECU 5 of the outboard motor 1*a* according to the fifth preferred embodiment shall be explained with reference to FIG. 2 and FIGS. 11 to 13. Although FIG. 13 shows a case where switching from the forward drive state to the neutral state is performed, the switching from the reverse drive state to the neutral state is performed in likewise manner. Also, the flowchart of FIG. 12 differs from the flowchart of FIG. 4 (first preferred embodiment) in that step S13 to step S15 are carried out between step S2 and step S3.

In step S2 of FIG. 12, the ECU 5 determines whether or not a shift-out operation is performed. For example, when as shown in FIG. 13, the lever 103*a* is operated to change from the forward drive notch position F (see FIG. 2) to the neutral notch position N (time t5), an affirmative determination is made in step S2. In this case, in step S13 of FIG. 12, the ECU 5 determines whether or not the variable troll control is being performed. More specifically, the ECU 5 determines whether or not the variable troll control commanding signal is received. If the variable troll control is not being performed, the process of the ECU 5 enters step S3.

In the case where the variable troll control is being performed (step S13: YES), the ECU 5 starts a throttle opening control at the same time as the detection of the shift-out operation (t5) in step S14. That is, the ECU 5 starts to control the actuator 15*a* to close the throttle valve 15 (see FIG. 2) that has been opened by the variable troll control. Then, in step S15, the ECU 5 determines whether or not a set time has elapsed from the shift-out operation (step S2).

This set time is a time (a time from t5 to t2) depending on to the engine speed (target rotation speed) set in the variable troll control or to the throttle opening at the time of the shift-out operation. Specifically, this set time preferably is approximately 200 milliseconds to approximately 300 milliseconds, for example. This set time is one example of a "second delay time" according to a preferred embodiment of the present invention.

If the set time has not elapsed (step S15: NO), step S14 and step S15 are repeated until the set time period elapses. In the interval until the set time period elapses (the interval from the time points t5 to t2), the engine speed decreases from the target rotation speed (a rotation speed higher than the idling rotation speed), set in the variable troll control, to near the idling rotation speed. In other words, the set time period is set to a value approximating a time amount required for the engine speed to decrease from the target rotation speed to the idling rotation speed. The ECU 5 may set such a set time period based on the target rotation speed or the throttle opening at the time of the shift-out operation.

After the elapse of the set time period (step S15: YES), step S3 to step S11 are performed in the same manner as in the first preferred embodiment.

As described above, with the fifth preferred embodiment, when the shift-out operation is performed while the variable troll control is being performed, the ECU 5 starts the misfire control after elapse of the set time period (second delay time period). Further, the ECU 5 starts the switching (shift-out) from the forward drive or reverse drive state to the neutral state after the elapse of the first delay time period from the start of the misfire control. Application of large loads on the shift actuator 41 and the forward-reverse switching mechanism unit 4 can thus be suppressed or prevented when the shift-out operation is performed by the user in the state where the engine speed is maintained at a high rotation speed by the variable troll control.

To explain specifically, even when the misfire control is performed from the shift-out operation, there is a possibility that the engine speed is not sufficiently decreased at the point in time when the first delay time period has elapsed from the shift-out operation. Thus, in the fifth preferred embodiment, ECU 5 delays the start of the misfire control by the set time period (second delay time period) from the shift-out operation and further delays the shift drive by the first delay time period from the start of misfire control. The switching (shift-out) from the forward drive or reverse drive state to the neutral state can thereby be started in a state where the engine speed has decreased sufficiently. The shift-out can thereby be executed reliably in a state where the loads applied to the shift actuator 41 and the forward-reverse switching mechanism unit 4 are small.

Also, in the fifth preferred embodiment, the delay of the set time period (second delay time period) arises in addition to the first delay time period when the shift-out operation is performed during the variable troll control. Therefore, the amount of time from the shift operation to the actual start of the shift drive is thus long as compared to the case where the shift-out operation is performed when the variable troll control is not performed. However, in a case where the shift-out operation is performed in a state where the engine speed is high and the speed of the hull 100*a* is high before the shift-out operation, the user is much less likely to feel the lag of the shift drive. That is, because the throttle valve 15 is closed and the engine speed drops at the same time as the shift-out operation, the speed of the hull 100*a* starts to decrease at the same time as the shift-out operation. Accordingly, the behavior of the hull 100*a* is thus substantially the same behavior as that in the case where shift drive is performed at the same time as the shift-out operation, and the user is thus much less likely to feel the lag of the shift drive.

While five preferred embodiments of the present invention have thus been described above, the present invention may be embodied in many other ways.

For example, although with each of the first to fifth preferred embodiments, an example is described where the present invention is preferably applied to an outboard motor that is one example of a marine vessel propulsion device, the present invention is not restricted thereto and may be applied to an inboard motor or an inboard/outboard motor. Furthermore, the present invention may also be applied to a water jet propulsion vessel, such as a Marine Jet (registered trademark) that includes an impeller (thrust generating unit).

Also, although with each of the first to fifth preferred embodiments, an example is described where two cylinders among four cylinders preferably are made to misfire during the misfire control, the present invention is not restricted thereto and all of the cylinders may be made to misfire. Also, although with each of the first to fifth preferred embodiments, an example is described where a four-cylinder engine is preferably used, the present invention is not restricted thereto and a one-cylinder engine may be used or a multi-cylinder engine other than a four-cylinder engine may be used, for example.

Also, although with each of the second to fifth preferred embodiments, an example is described where the start of driving of the shift actuator 41 is preferably delayed by the computed maximum lag time amount (first delay time period), the present invention is not restricted thereto. For example, the ECU 5 may compute an accurate lag time amount (the amount of time from the point in time when the misfire control is started to the point in time when the misfiring is actually started) and may delay the start of driving of the shift actuator 41 by this accurate lag time amount. The switching from the forward drive state or the reverse drive state to the neutral state can thereby be started at a better timing based on the predicted lag time amount even in a case where the lag time amount changes according to the state of the engine 2.

Also, although with each of the first to fifth preferred embodiments, the timing at which the ignition unit actually starts to misfire has been described as being the timing at which the misfiring is actually started (the scheduled timing of discharge of the misfired spark plug (scheduled discharge time)), the present invention is not restricted thereto. For example, the timing at which the ignition unit actually starts to misfire may be the point in time when the energization of the spark plug that is to misfire is started.

Also, although with each of the first to fifth preferred embodiments, an example is described in which the switching of the shift state is performed by moving the dog clutch 4*b* of the forward-reverse switching mechanism unit 4 by using the shift actuator 41, configured from a motor, the present invention is not restricted thereto. That is, an appropriate shift actuator (shift drive unit) may be used according to the shift switching mechanism that is applied and a shift actuator other than a motor may be used.

Also, although with the fifth preferred embodiment described above, an example is described in which the engine rotation commanding unit is preferably configured from the gauge unit 107, the present invention is not restricted thereto. For example, the engine rotation commanding unit may instead be configured from a simple switch.

A detailed description has been provided of the preferred embodiments of the present invention. However, the preferred embodiments are only specific examples to describe the technical content of the present invention, and the present invention is not to be construed as being limited to these specific examples. The spirit and scope of the present invention is restricted only by the appended claims.

The present application corresponds to Japanese Patent Application No. 2008-234249 filed in the Japan Patent Office on Sep. 12, 2008, and the entire disclosure of the application is incorporated herein by reference.

What is claimed is:

1. A marine vessel propulsion device, comprising:

an engine to generate a driving force by combustion of a fuel by an ignition unit;

a thrust generating unit driven by the driving force of the engine to generate thrust underwater;

a shift mechanism unit capable of switching between a transmitting state of transmitting the driving force of the engine to the thrust generating unit and a cut-off state of cutting off the driving force of the engine from the thrust generating unit;

a shift drive unit to drive the shift mechanism unit; and a control unit to electrically control the shift drive unit based on a position of a shift operational unit that is operated by a user to perform a shifting operation to a first shift position corresponding to the transmitting state, and a second shift position corresponding to the cut-off state; wherein the control unit temporarily lowers an engine speed by starting misfire control of the ignition unit when the shift operational unit is operated to change from the first shift position to the second shift position; and the control unit controls the shift drive unit, after a start of the misfire control, such that the shift mechanism unit starts switching from the transmitting state to the cut-off state after elapse of a first delay time period corresponding to an amount of time from a start of misfire control to a point in time when the ignition unit actually starts to misfire.

2. The marine vessel propulsion device according to claim 1, wherein the first delay time period is a fixed time period that is set in advance.

3. The marine vessel propulsion device according to claim 1, wherein when the shift operational unit is operated to change from the first shift position to the second shift position, the control unit starts the misfire control, predicts an amount of lag time from the start of the misfire control to the point in time when the ignition unit actually starts to misfire, and sets the predicted lag time amount as the first delay time period.

4. The marine vessel propulsion device according to claim 1, wherein the control unit controls the shift drive unit such that the shift mechanism unit starts the switching from the transmitting state to the cut-off state in an initial period in which the engine speed starts to decrease.

5. The marine vessel propulsion device according to claim 3, wherein the control unit determines, as the first delay time period, a predicted maximum lag time amount from the start of the misfire control to the point in time when the ignition unit actually starts to misfire.

6. The marine vessel propulsion device according to claim 5, wherein the control unit computes an ignition interval based on a number of cylinders of the engine and an engine speed when the shift operation unit is operated to change from the first shift position to the second shift position, and computes the predicted maximum lag time amount based on the ignition interval.

7. The marine vessel propulsion device according to claim 6, wherein the control unit determines a timing of ignition of the ignition unit by a timer that is set for each ignition of the ignition unit, and the control unit computes the predicted maximum lag time amount based on a time period of the timer in addition to the number of cylinders of the engine and the engine speed.

8. The marine vessel propulsion device according to claim 5, wherein the engine has a plurality of cylinders, the misfire control is performed by making the ignition unit of a pre-designated cylinder, among the plurality of cylinders, misfire, and the control unit computes, as the first delay time period, the predicted maximum lag time amount from the point in time when the misfire control is started to a point in time when the ignition unit of the pre-designated cylinder actually starts to misfire.

9. The marine vessel propulsion device according to claim 1, wherein the control unit controls the engine speed based on a state of an engine rotation commanding unit, which is separate from the shift operational unit and maintains the engine speed at a predetermined rotation speed based on an operation by the user, and in a case where the engine speed is controlled based on the state of the engine speed commanding unit, the control unit starts the misfire control after elapse of a second delay time period from the operation of the shift operation unit from the first shift position to the second shift position and controls the shift drive unit such that the shift mechanism unit starts the switching from the transmitting state to the cut-off state after elapse of the first delay time period after the start of the misfire control.

10. A marine vessel, comprising:

a hull; and a marine vessel propulsion device attached to the hull and including:

an engine to generate a driving force by combustion of a fuel by an ignition unit;

a thrust generating unit driven by the driving force of the engine to generate thrust underwater;

a shift mechanism unit capable of switching between a transmitting state of transmitting the driving force of the engine to the thrust generating unit and a cut-off state of cutting off the driving force of the engine from the thrust generating unit;

a shift drive unit to drive the shift mechanism unit; and a control unit to electrically control the shift drive unit based on a position of a shift operational unit that is operated by a user to perform a shifting operation to a first shift position corresponding to the transmitting state, and a second shift position corresponding to the cut-off state; wherein the control unit temporarily lowers an engine speed by starting misfire control of the ignition unit when the shift operational unit is operated to change from the first shift position to the second shift position; and the control unit controls the shift drive unit, after the start of the misfire control, such that the shift mechanism unit starts switching from the transmitting state to the cut-off state after elapse of a first delay time period corresponding to an amount of time from a start of misfire control to a point in time when the ignition unit actually starts to misfire.

11. The marine vessel according to claim 10, wherein the first delay time period is a fixed time period that is set in advance.

12. The marine vessel according to claim 10, wherein when the shift operational unit is operated to change from the first shift position to the second shift position, the control unit starts the misfire control, predicts an amount of lag time from the start of the misfire control to the point in time when the ignition unit actually starts to misfire, and sets the predicted lag time amount as the first delay time period.

13. The marine vessel according to claim 10, wherein the control unit controls the shift drive unit such that the shift mechanism unit starts the switching from the transmitting state to the cut-off state in an initial period in which the engine speed starts to decrease.

14. The marine vessel according to claim 12, wherein the control unit determines, as the first delay time period, a predicted maximum lag time amount from the start of the misfire control to the point in time when the ignition unit actually starts to misfire.

15. The marine vessel according to claim 14, wherein the control unit computes an ignition interval based on a number of cylinders of the engine and an engine speed when the shift operation unit is operated to change from the first shift position to the second shift position, and computes the predicted maximum lag time amount based on the ignition interval.

16. The marine vessel according to claim 15, wherein the control unit determines a timing of ignition of the ignition unit by a timer that is set for each ignition of the ignition unit, and the control unit computes the predicted maximum lag time amount based on a time period of the timer in addition to the number of cylinders of the engine and the engine speed.

17. The marine vessel according to claim 14, wherein the engine has a plurality of cylinders, the misfire control is performed by making the ignition unit of a pre-designated cylinder, among the plurality of cylinders, misfire, and the control unit computes, as the first delay time period, the predicted maximum lag time amount from the point in time when the misfire control is started to a point in time when the ignition unit of the pre-designated cylinder actually starts to misfire.

18. The marine vessel according to claim 10, wherein the control unit controls the engine speed based on a state of an engine rotation commanding unit, which is separate from the shift operational unit and maintains the engine speed at a predetermined rotation speed based on an operation by the user, and in a case where the engine speed is controlled based on the state of the engine speed commanding unit, the control unit starts the misfire control after elapse of a second delay time period from the operation of the shift operation unit from the first shift position to the second shift position and controls the shift drive unit such that the shift mechanism unit starts the switching from the transmitting state to the cut-off state after elapse of the first delay time period after the start of the misfire control.

* * * * *